US005909611A

United States Patent [19]

Iwakura

[11] Patent Number: 5,909,611

[45] Date of Patent: Jun. 1, 1999

[54] IMAGE FORMING APPARATUS

[75] Inventor: Yoshie Iwakura, Nara, Japan

[73] Assignee: Sharp Kabushiki Kaisha, Osaka, Japan

[21] Appl. No.: 09/090,152

[22] Filed: Jun. 2, 1998

[30] Foreign Application Priority Data

Jun. 6, 1997 [JP] Japan ..... 9-149088

[51] Int. Cl.[6] ..... G03G 15/01; G03G 15/16

[52] U.S. Cl. ..... 399/302; 399/297; 399/303; 399/308

[58] Field of Search ..... 399/302, 308, 399/297, 303; 492/28, 29, 30, 31, 32, 33, 34, 35, 36, 37, 53, 54, 55, 56

[56] References Cited

U.S. PATENT DOCUMENTS

| | | | |
|---|---|---|---|
| 5,390,012 | 2/1995 | Miyashiro et al. . | |
| 5,623,329 | 4/1997 | Yamauchi et al. . | |
| 5,669,052 | 9/1997 | Kusaba et al. | 399/308 |
| 5,745,831 | 4/1998 | Nakazawa et al. | 399/308 |
| 5,752,130 | 5/1998 | Tanaka et al. | 399/101 |
| 5,761,571 | 6/1998 | Suzuki et al. | 399/66 |
| 5,765,084 | 6/1998 | Asada et al. | 399/302 |
| 5,771,430 | 6/1998 | Iwakura | 399/31 |

*Primary Examiner*—Richard Moses
*Assistant Examiner*—Shival Virmani

[57] ABSTRACT

Stable attraction of the transfer paper and stable toner transfer are ensured by preventing an electrostatic attracting force of transfer paper from lowering as charge accumulated on the transfer paper moves through ends of a transfer drum thereby declining. The transfer drum provided in a transfer section is composed of a dielectric layer, a semi-conductive layer, and a conductive layer laminated in this order from a transfer paper side, and there are further provided a power source section for applying a predetermined voltage to the conductive layer, and a grounded conductive roller which comes into contact with a surface portion, on an upstream side to a transfer point, of the dielectric layer with the transfer paper therebetween. Further, an insulating material is applied to ends of at least one of the dielectric layer, the semi-conductive layer, and the conductive layer.

29 Claims, 13 Drawing Sheets

IMAGE FORMING APPARATUS

FIELD OF THE INVENTION

The present invention relates to an image forming apparatus for use in a laser printer, a copying machine, a laser facsimile, or the like.

BACKGROUND OF THE INVENTION

There has conventionally been an image forming apparatus which is arranged so that to visualize an electrostatic latent image formed on a photosensitive drum, toner is adhered thereto, and a resultant toner image is transferred onto a transfer material wound around a transfer drum.

As shown in FIG. 19, such an image forming apparatus includes a cylinder 101 having a dielectric layer 101*a*, in which corona chargers 102 and 104 are separately provided. The corona charger 102 is intended to attract a transfer material P, while the corona charger 104 is intended to transfer a toner image formed on a surface of the photosensitive drum 103 onto the transfer material P, and with these charger 102 and 104, the attraction of the transfer material P and the transfer operation are independently performed.

As shown in FIG. 20, there has also been another image forming apparatus which includes a double-layer cylinder 201 and a grip system 202. The cylinder 201 has an outer semi-conductive layer 201*a* and an inner base 201*b*, and the grip system 202 is intended to hold the transfer material P transported thereto along a circumferential surface of the cylinder 202. In this image forming apparatus, an edge of the transfer material P transported to the grip system 202 is caught by the grip system 202 so that the transfer material P is held along the surface of the cylinder 201, and thereafter the toner image formed on the photosensitive drum 103 is transferred onto the transfer material P. In this case, the surface of the cylinder 201 is charged either by applying a voltage to the semi-conductive layer 201*a* as the outer layer of the cylinder 201 or by causing a charger disposed inside the cylinder 201 to discharge.

In the case of the image forming apparatus shown in FIG. 19, however, the following problem arises: since the cylinder 101 serving as a transfer drum has a single-layer structure including only the dielectric layer 101*a*, the corona chargers 102 and 104 need to be provided inside the cylinder 101, thereby necessarily limiting the size of the cylinder 101 and making the apparatus bulkier.

The image forming apparatus shown in FIG. 20 needs less chargers, since the cylinder 201 serving as a transfer drum is arranged in the double-layer structure so that the cylinder 201 is charged for transferring the toner image to the transfer material P. The overall structure of this image forming apparatus, however, is complicated since it is equipped with the grip system 202.

Meanwhile, the Japanese Publication for Laid-Open Patent Application No.173435/1993 (Tokukaihei 5-173435) has disclosed an image forming apparatus provided with a transfer drum having a conductive drum base, a resilient layer, and a dielectric layer. The resilient layer is formed on the conductive drum base and is made of a foam material, and the dielectric layer covers the resilient layer. This image forming apparatus has a mechanism with which toner images of respective colors which are sequentially formed on the photosensitive drum are sequentially transferred onto transfer paper attracted to the transfer drum so as to be superimposed on one another, thereby producing a full-color image on the transfer paper.

In this image forming apparatus, an attracting roller as charging means is disposed close to the transfer drum. By applying a voltage to the attracting roller, discharge is caused in a gap between the drum base and the dielectric layer, thereby generating electric charge. As a result, the transfer paper is electrostatically attracted onto the dielectric layer. Here, the foam material serves as a gap keeping material.

The foregoing image forming apparatus, however, has a drawback in the number of power sources. Specifically, at least two power sources are necessitated. One is a power source for causing the attracting roller to attract the transfer paper to the transfer drum, and the other is a power source for applying to the transfer paper a voltage with an opposite polarity of that of the toner so that the toner image is transferred to the transfer paper wound around the transfer drum.

To solve the drawback, the applicant of the present application has proposed an image forming apparatus (for example, the Patent Application No. 295194/1994 (Tokuganhei 6-295194)) having (1) a photosensitive drum (image carrying body) on which a toner image is formed, (2) a transfer drum (transfer means main body) composed of a dielectric layer, a semi-conductive layer, and a conductive layer formed in this order from a surface of contact with the transfer paper, (3) a power source (voltage applying means) for applying a predetermined voltage to the conductive layer, and (4) a ground roller (potential difference producing means) for pressing the transfer paper against the surface of the dielectric layer and for producing a potential difference between the voltage-applied conductive layer and the transfer paper. The ground roller is disposed on an upstream side, in the transfer paper transporting direction, to a position at which the transfer is performed.

In the image forming apparatus, a potential difference is produced between the conductive layer and the transfer paper by applying a voltage to the conductive layer of the transfer drum while pressing the ground roller against the transfer drum with the transfer paper therebetween, and this potential difference causes local discharge in a region (hereinafter referred to as a contact region) where the ground roller is brought into contact with the transfer drum by pressure, thereby causing injection of charge. As a result, charge with a polarity opposite to that of the voltage applied to the conductive layer is induced on the transfer paper and accumulated thereon, whereby the transfer paper is electrostatically attracted to the dielectric layer. Further, the voltage applied to the conductive layer causes the toner image to be transferred onto the transfer paper.

With this arrangement, the voltage required may be lower and the control of voltage is easily performed, since the attraction of and the transfer with respect to the transfer paper are executed by the local discharge occurring in the contact region and the accompanying injection of charge. Besides, the image forming apparatus can be manufactured at a lower cost, since the power source for causing the transfer paper to adhere to the surface of the dielectric layer, that is, the surface of the transfer means, and the power source for causing the toner image formed on the image carrying body to be transferred onto the transfer paper may not be separately formed.

Tokuganhei 6-295194, however, does not explain in detail an arrangement of ends, in a direction of a rotational axis thereof (a direction orthogonal to a rotational direction), of the transfer drum. The applicant has eagerly studied for further perfection of the image forming apparatus of that invention, and as a result it was discovered that under conditions of high temperature and high humidity, the electrostatic attractive force exerted to the transfer material might lower thereby causing imperfect transfer. This is explained as follows: since under the condition of high temperature and high humidity, respective surface electric resistances of the layers constituting the transfer drum lower, the electric charge accumulated on the transfer paper moves through the surface of the dielectric layer and the ends of the transfer drum to the semi-conductive layer, and then, to the conductive layer through a surface of the semi-conductive layer.

SUMMARY OF THE INVENTION

The object of the present invention is to further improve the image forming apparatuses disclosed in the aforementioned applications, and to provide an image forming apparatus which is capable of maintaining an electrostatic attracting force with respect to the transfer material, thereby ensuring stable electrostatic attraction and stable toner transfer, even though respective surface electric resistances of the layers constituting the transfer drum lower under conditions of high temperature and high humidity.

To achieve the above object, the image forming apparatus of the present invention is characterized in comprising (1) an image carrying body on which a toner image is formed, and (2) transfer means for transferring the toner image formed on the image carrying body to a transfer material, by bringing the transfer material into contact with the image carrying body while transporting the transfer material, wherein (i) the transfer means includes a transfer main body having a dielectric layer, a semi-conductive layer, and a conductive layer laminated in this order from a contact surface side of the transfer material, (ii) the transfer material is transported between ends of the transfer main body, in a direction crossing a direction of a line connecting the ends of the transfer main body, and (iii) an insulating material is applied to ends of at least one of the dielectric layer, the semi-conductive layer, and the conductive layer, the ends thereof being positioned at the ends of the transfer main body.

With the foregoing arrangement, decline of charge in the transfer main body does not occur even in the case where the image forming apparatus is used in conditions of high temperature and high humidity and surface electric resistances of the dielectric layer and the semi-conductive layer constituting the transfer main body lower. Normally under such conditions the charge accumulated on the transfer material moves through the surface of the dielectric layer, which has now a lower electric resistance, and conducts to the semi-conductive layer through the ends of the transfer main body, then further moves to the conductive layer. In the above arrangement, however, such phenomenon is prevented since the insulating material is applied to the ends of at least one of the dielectric layer, the semi-conductive layer, and the conductive layer. As a result, stable electrostatic attraction of the transfer material in any environment is ensured, and stable toner transfer can be performed.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) is a perspective view, partly in cross section, of principal parts of the transfer drum, for explaining the insulating material application with respect to the transfer drum.

DESCRIPTION OF THE PREFERRED EMBODIMENTS

Figure 1:
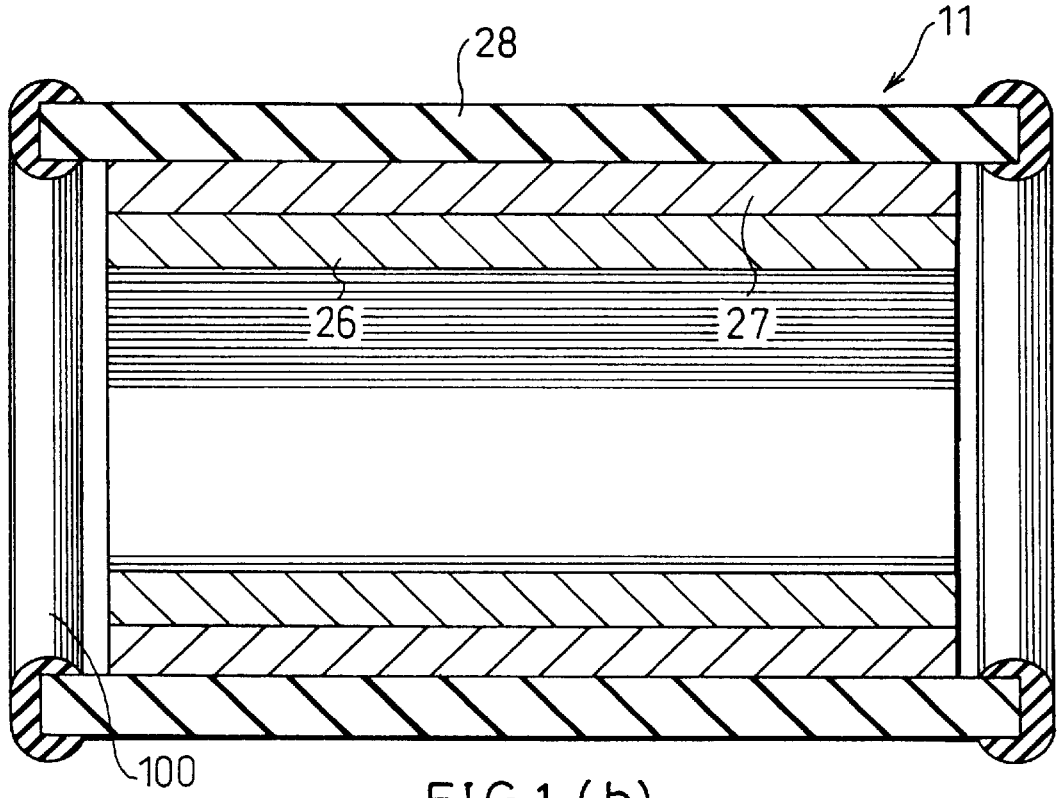
FIG. 1(*a*) is a cross-sectional view illustrating insulating material application with respect to a transfer drum provided in an image forming apparatus in accordance with an embodiment of the present invention.
Figure 1:
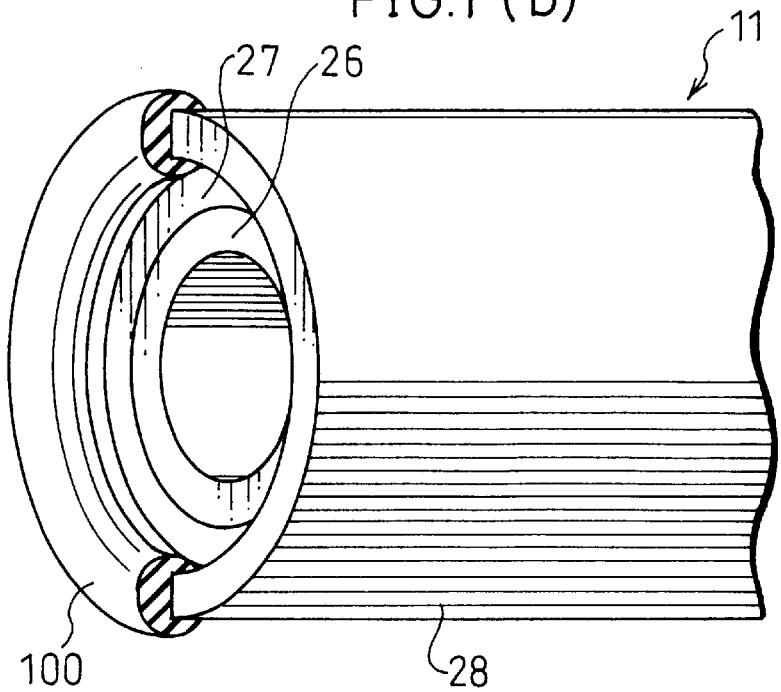

The following description explains one embodiment of the present invention while referring to the drawings.

Figure 2:
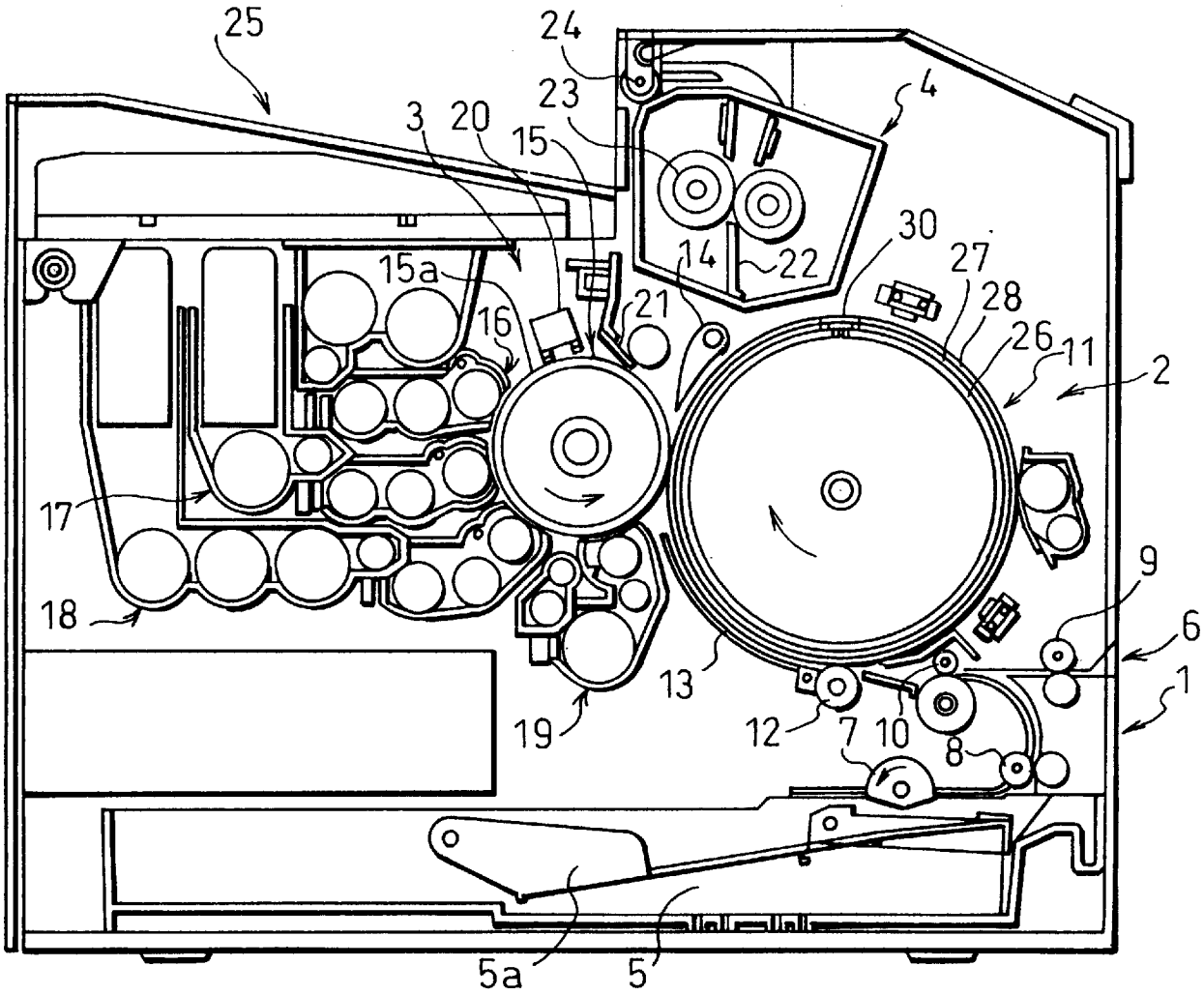
FIG. 2 is a view illustrating an arrangement of the image forming device incorporating the transfer drum.

As illustrated in FIG. 2, an image forming apparatus of the present invention includes a feeding section 1, a transfer section (transfer means) 2, a development section 3, and a fixing section 4. The feeding section 1 stores and feeds transfer paper (transfer material) P (see FIG. 3) as recording paper on which an image is to be formed by toner. The transfer section 2 transfers a toner image to the transfer paper P. The development section 3 forms the toner image. The fixing section 4 fuses the toner image transferred to the transfer paper P and fixes the toner image thereon.

The feeding section 1 includes a feed cassette 5, a manual-feed section 6, a pickup roller 7, PF (paper feeding) rollers 8, manual-feed rollers 9, and pre-curl rollers 10. The feed cassette 5 is disposed on the lowest level of a main body of the image forming apparatus so that it is freely attachable to and detachable from the main body. The feed cassette 5 stores transfer paper P and supplies it to the transfer section 2. The manual-feed section 6 is located on the front side of the main body and through which the transfer paper P is manually supplied sheet by sheet from the front side. The pickup roller 7 feeds one sheet at a time from the topmost sheet of the transfer paper P in the feed cassette 5. The PF rollers 8 transport the transfer paper P fed by the pickup roller 7. The manual-feed rollers 9 transport the transfer paper P fed from the manual-feed section 6. The pre-curl rollers 10 curl the transfer paper P which has been transported by the PF rollers 8 or the manual-feed rollers 9.

The feed cassette 5 has a feeding member 5*a* pushed upward by, for example, a spring. The transfer paper P is placed on the feeding member 5*a* in the feed cassette 5, and the topmost sheet of the transfer paper P comes into contact with the pickup roller 7. When the pickup roller 7 is rotated in the direction of an arrow, the transfer paper P is fed sheet by sheet to the PF rollers 8. The transfer paper P is then transported to the pre-curl rollers 10.

Meanwhile, the transfer paper P supplied from the manual-feed section 6 is transported to the pre-curl rollers 10 by the manual-feed rollers 9.

As described above, the pre-curl rollers 10 curl the transported transfer paper P so that it easily adheres to a surface of a cylindrical transfer drum 11 in the transfer section 2.

The transfer section 2 includes the transfer drum (transfer main body) 11. Disposed around the transfer drum 11 are a ground roller 12, a guide member 13, and a separating claw 14. The ground roller 12 functions as grounded potential-difference producing means and rotates as the transfer drum 11 is rotated. The guide member 13 guides the transfer paper P so that it is not separated from the transfer drum 11. The separating claw 14 forcefully separates the transfer paper P adhering to the transfer drum 11. The separating claw 14 is movable to touch or separate from the surface of the transfer drum 11. The structure and function of the transfer section 2 will be explained in detail later.

The development section 3 includes a photosensitive drum (image carrying body) 15 which is brought into contact with the transfer drum 11 by pressure. The photosensitive drum 15 is composed of a grounded conductive aluminum tube 15*a*, and an OPC (organic photoconductor) film 15*b* (see FIGS. 8 and 9) laminated on a surface thereof.

Arranged radially around the photosensitive drum 15 are developer containers 16, 17, 18 and 19, a charger 20, and a cleaning blade 21. The developer containers 16, 17, 18, 19 contain yellow, magenta, cyan and black toners, respectively. The charger 20 charges the surface of the photosensitive drum 15. The cleaning blade 21 scrapes and removes the toner remaining on the surface of the photosensitive drum 15. Toner images in the respective colors are formed on the photosensitive drum 15. More specifically, with the photosensitive drum 15, a series of charging, exposing, developing and transfer processes are carried out for each of toner colors. Therefore, when transferring a color image, a toner image in one color is transferred to the transfer paper P which is electrostatically attracted to the transfer drum 11 by one rotation of the transfer drum 11. Namely, a color image is obtained by a maximum of four rotations of the transfer drum 11.

The fixing section 4 includes fixing rollers 23, and a fixing guide 22. The fixing rollers 23 fix the toner image to the transfer paper P by fusing the toner image at predetermined temperature and pressure. The transfer paper P, which has been separated from the transfer drum 11 by the separating claw 14 after the transfer of the toner image, is guided to the fixing rollers 23 by the fixing guide 22.

A discharge roller 24 is disposed at a downstream section of the transfer-paper transport path in the fixing section 4 so that the transfer paper P with the toner image fixed thereon is discharged from the main body of the apparatus onto an output tray 25.

The following description will explain in detail the transfer section 2 which has characteristics of the present invention.

First, the following description discusses the structure of the transfer drum 11.

Figure 3:
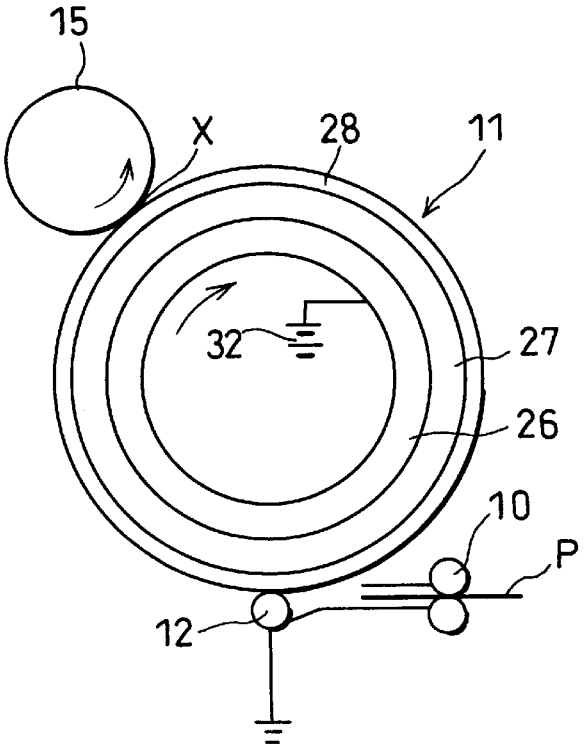
FIG. 3 is a view illustrating an arrangement of a transfer section incorporating the transfer drum.

As illustrated in FIG. 3, the transfer drum 11 includes a cylindrical base made of, for example, aluminum, which base constitutes a conductive layer 26, a semi-conductive layer 27 on an upper surface of the conductive layer 26, and a dielectric layer 28 on an upper surface of the semi-conductive layer 27. The conductive layer 26 is connected with a power source 32 as voltage applying means so that a voltage is stably maintained throughout the conductive layer 26.

To form the semi-conductive layer 27, a resilient semi-conductive foam material such as urethan rubber or elastomer may be used. By making the semi-conductive layer 27 of a resilient semi-conductive foam material, resiliency is rendered to the surface of the transfer drum 11, whereby a nip width between the transfer drum 11 and the photosensitive drum 15 is easily adjusted.

On the other hand, to form the dielectric layer 28, a polymer film made of a dielectric material such as PVDF (polyvinylidene fluoride) may be used. In the case where the dielectric layer 28 is formed by using PVDF, it is possible to form PVDF in a seamless cylindrical thin film form and fix it to the semi-conductive layer 27.

Figure 4:
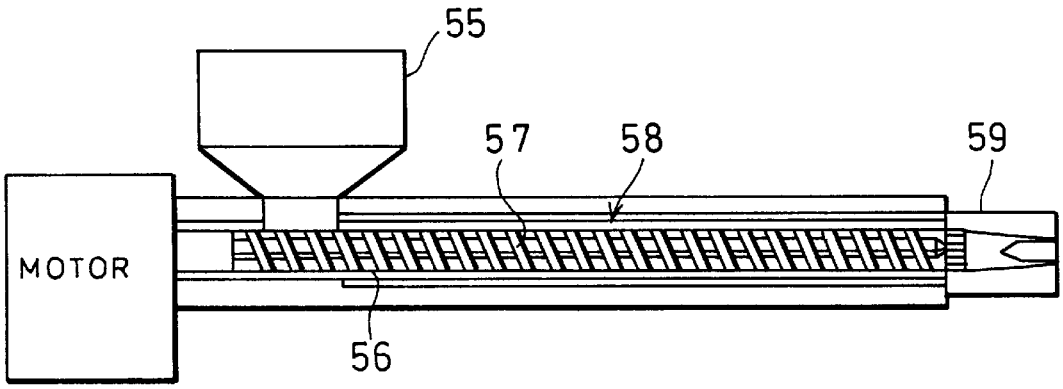
FIG. 4 is a view illustrating an arrangement of an extruding section of an extruder used for manufacturing the transfer drum.
Figure 5:
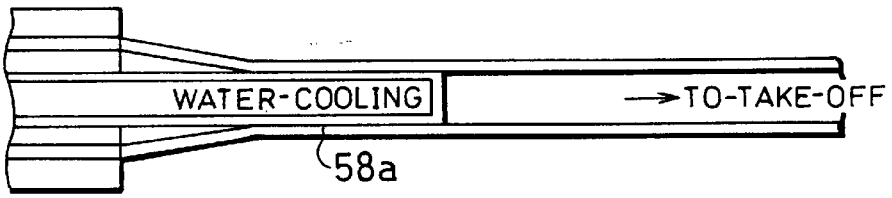
FIG. 5 is a view illustrating an arrangement of a sizing section of the extruder shown in FIG. 3.
Figure 6:
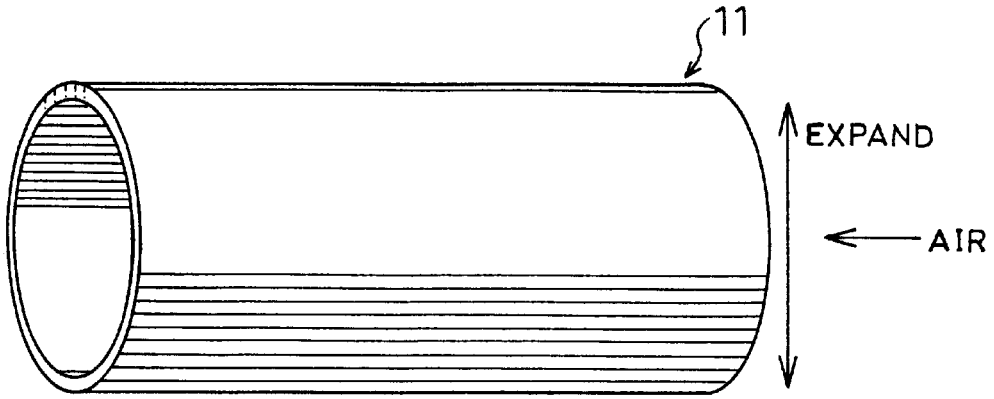
FIGS. 6(*a*) through 6(*c*) are views showing an example of a process for combining a dielectric layer with a semi-conductive layer and a conductive layer of the transfer drum.
Figure 6:
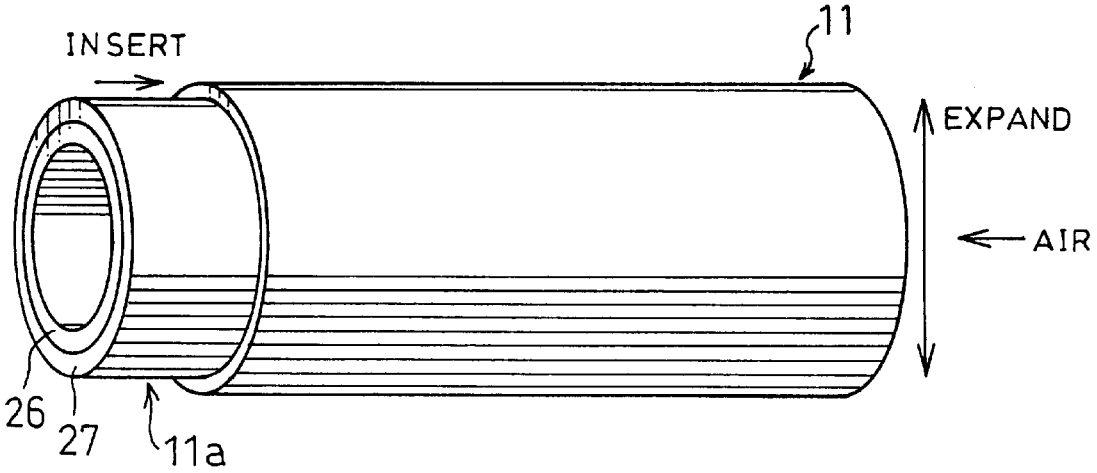
Figure 6:
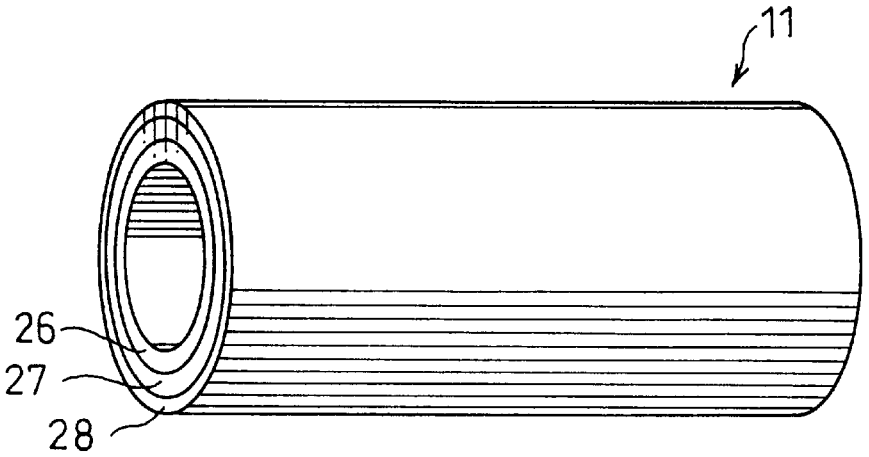

Here, the following description will briefly explain a process of forming PVDF in the seamless cylindrical thin film and fixing it to the semi-conductive layer 27, while referring to FIGS. 4 through 6. FIG. 4 illustrates an extruding section of a general extruder for heating and extruding a molding material, while FIG. 5 illustrates a sizing section which cools and solidifies the molding material extruded by the extruding section so that it has an appropriate shape.

As shown in FIG. 4, a pellet of PVDF is supplied from a material hopper 55 into the extruder. The PVDF thus supplied is heated in a cylinder 56 thereby becoming fused, and is sent to a dying section 57 by a screw 57. Then, the PVDF is jetted out of the cylinder 56 through a circular opening of the dying section 59. When passing through the dying section 59, the PVDF is molded and the shape and thickness thereof are determined, thereby becoming a seamless cylinder. Thereafter, the PVDF thus formed in the seamless cylindrical form is transported to the sizing section, where as shown in FIG. 5 the shape and size of the PVDF are controlled from the inside by water cooling in a cooling section 58*a* of a heating-cooling unit 58. Finally the PVDF cylindrical thin film is cut to a predetermined size by a take-off.

To fix on the semi-conductive layer 27 the dielectric layer 28 thus formed in the PVDF seamless cylindrical thin film, first, as shown in FIG. 6(*a*), the dielectric layer 28 is expanded by injecting air therein, and then, as shown in FIG. 6(*b*), a transfer drum 11*a* formed by fixing the semi-conductive layer 27 on the conductive layer 26 is inserted into the dielectric layer 28. Thereafter, as shown in FIG. 6(*c*), air injection is stopped, whereby the dielectric layer 28 shrinks since it is no longer expanded due to wind pressure. As a result, the dielectric layer 28 is fixed onto a surface of the outermost layer of the transfer drum 11*a*, that is, the semi-conductive layer 27.

By this fixing method, the dielectric layer 28 can be fixed without gap onto the conductive layer 26 with the semi-conductive layer 27 therebetween, and good adherence therebetween can be achieved. Therefore, adhesion of the transfer paper P to the transfer drum 11 and toner transfer performance are enhanced.

Figure 7:
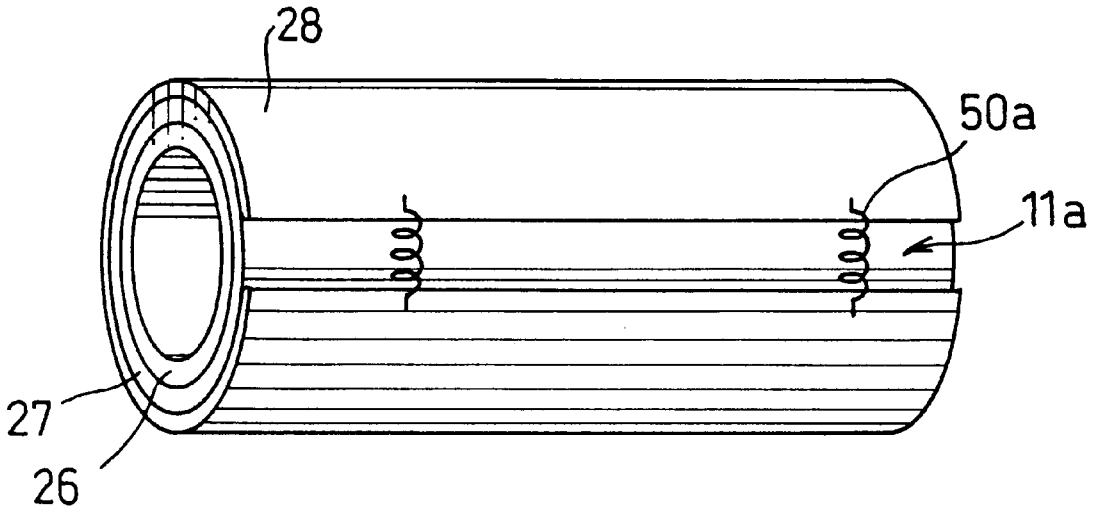
FIGS. 7(*a*) and 7(*b*) are views showing another example of a process for combining the dielectric layer with the semi-conductive layer and the conductive layer of the transfer drum.
Figure 7:
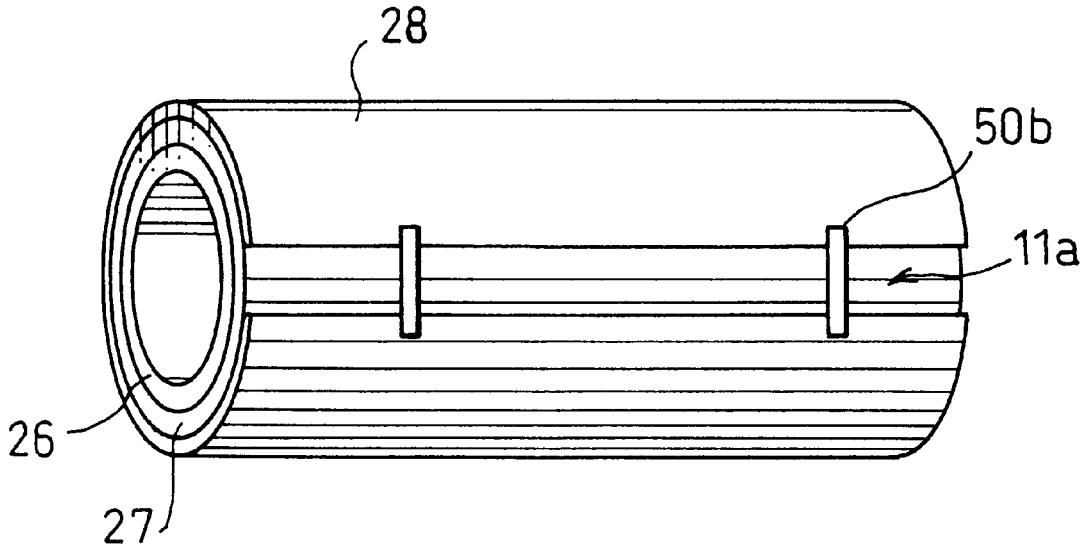

The above description has explained a method wherein PVDF is formed in a seamless cylindrical thin film to be used as the dielectric layer 28 and is fixed on the semi-conductive layer 27. Other methods, however, can be utilized. For example, as shown in FIG. 7(*b*), a sheet-form PVDF may be used to form the dielectric layer 28. In this case, the sheet-form PVDF is wound around the transfer drum 11*a* formed by fixing the semi-conductive layer 27 on the conductive layer 26, and the sheet used as the dielectric layer 28 is stretched and fixed by pulling ends thereof in a sheet winding direction with the use of pulling members 50*a* composed of springs or pulling members 50*b* made of rubber.

Furthermore, in the transfer drum 11, an insulating material is applied to ends, in the rotating axis direction of the transfer drum 11, of at least one of the dielectric layer 28, the semi-conductive layer 27, and the conductive layer 26, so that electric charge on the transfer paper P electrostatically attracted to the surface of the dielectric layer 28 may not decline by moving away from the surface of the dielectric layer 28 to the surface of the semi-conductive layer 27, then to the conductive layer 26 through the ends thereof.

FIGS. 1(*a*) and 1(*b*), 8 through 13 show concrete examples of the transfer drum 11 in which the insulating material is applied to the ends.

The transfer drum 11 shown in FIGS. 1(*a*) and 1(*b*) is arranged such that the both ends of the dielectric layer 28 jut out, compared with the ends of the semi-conductive layer 27 and the conductive layer 26, and that only the ends of the dielectric layer 28 are covered with insulating material 100 for an insulating purpose.

Figure 8:
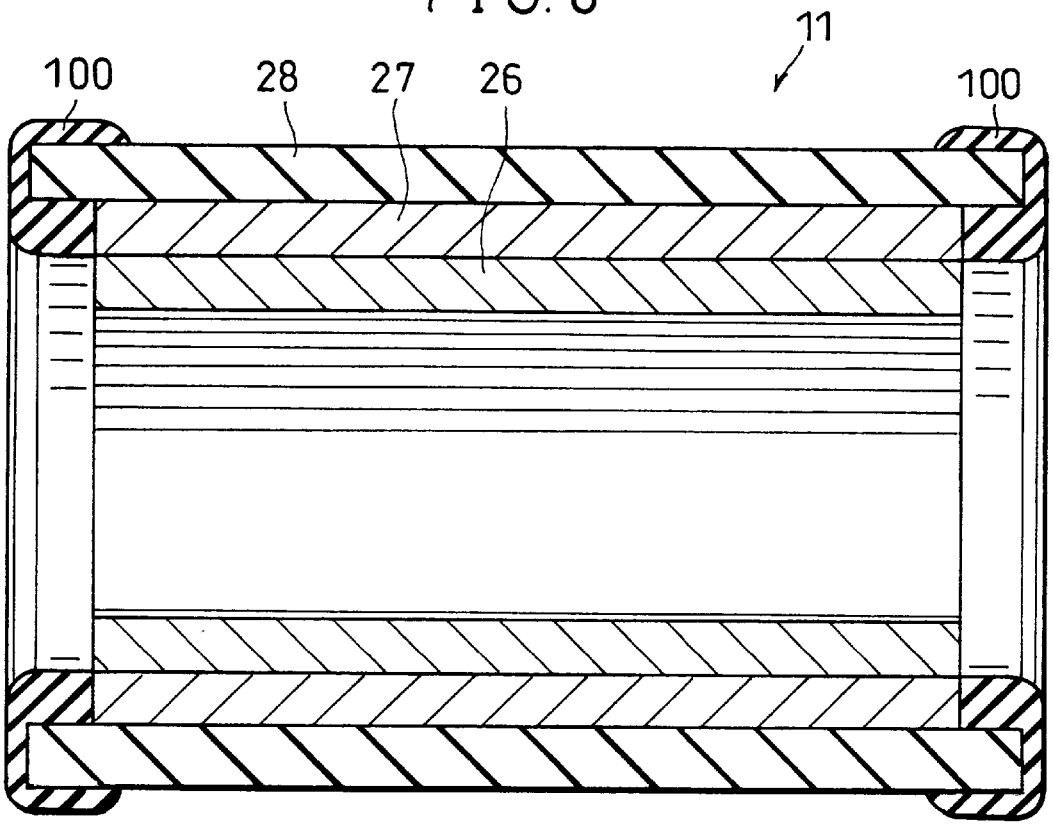
FIG. 8 is a cross-sectional view for explaining another insulating material application with respect to the transfer drum.

The transfer drum 11 shown in FIG. 8 is arranged such that the ends of the dielectric layer 28 and the semi-conductive layer 27 are covered with the insulating material 100 for the insulating purpose. In this case, regarding the semi-conductive layer 27, at least end surfaces of the ends thereof are covered with the insulating material 100.

Figure 9:
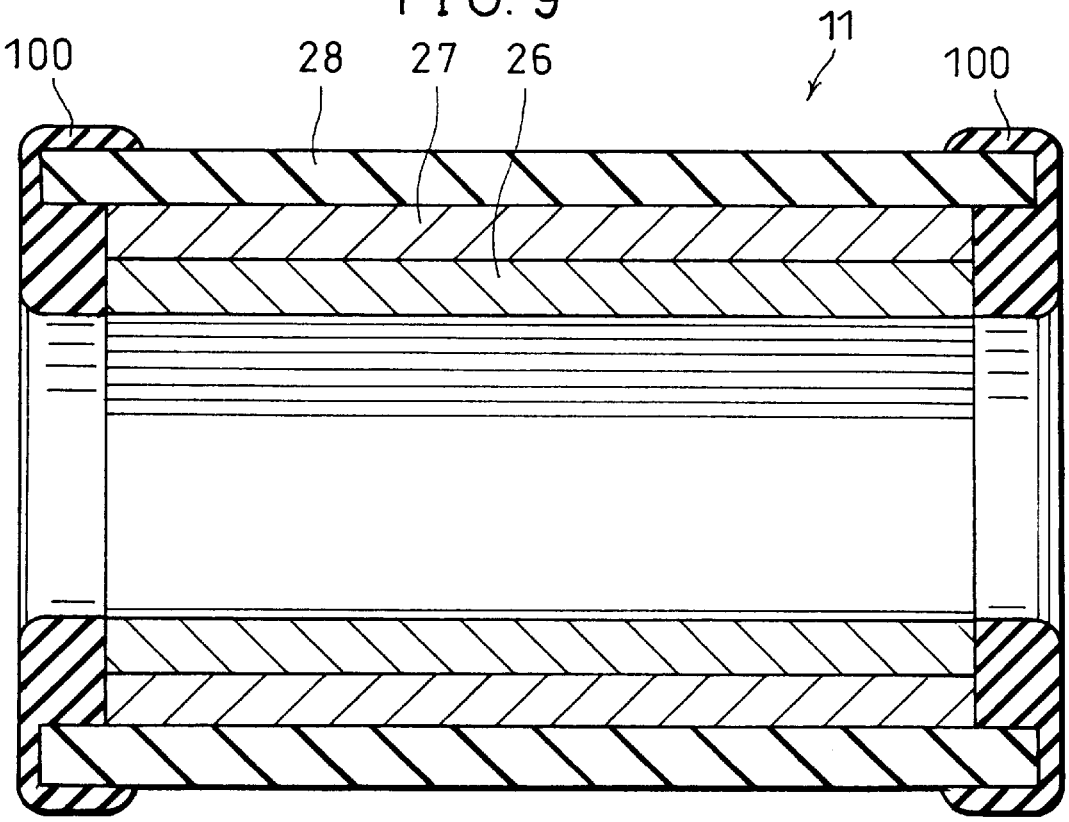
FIG. 9 is a cross-sectional view for explaining still another insulating material application with respect to the transfer drum.

The transfer drum 11 shown in FIG. 9 is arranged such that the ends of all the dielectric layer 28, the semi-conductive layer 27, and the conductive layer 26 are covered with the insulating material 100 for the insulating purpose. In this case, regarding the semi-conductive layer 27 and the conductive layer 26, at least end surfaces of the ends thereof are covered with the insulating material 100.

Figure 10:
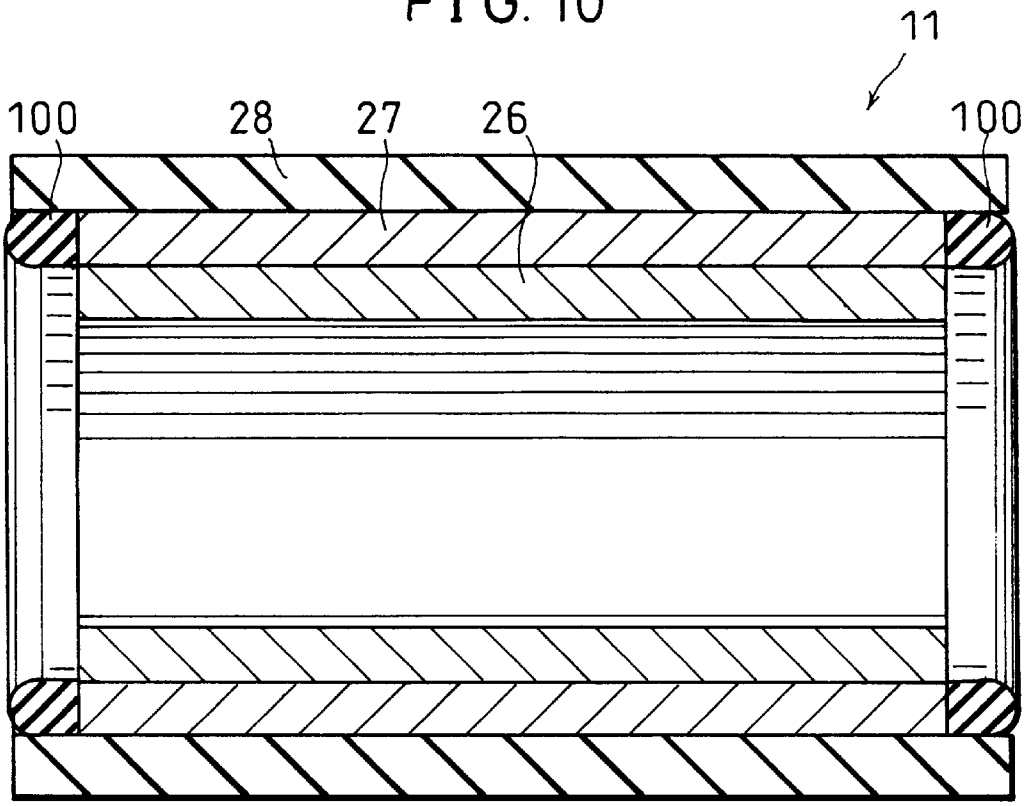
FIG. 10 is a cross-sectional view for explaining still another insulating material application with respect to the transfer drum.

The transfer drum 11 shown in FIG. 10 is arranged such that the ends of only the semi-conductive layer 27 are covered with the insulating material 100 for the insulating purpose. In this case, the insulating material 100 may be formed in a ring shape so that the ring-shaped insulating material 100 may be installed in a region on an inner side to the jut ends of the dielectric layer 28.

Figure 11:
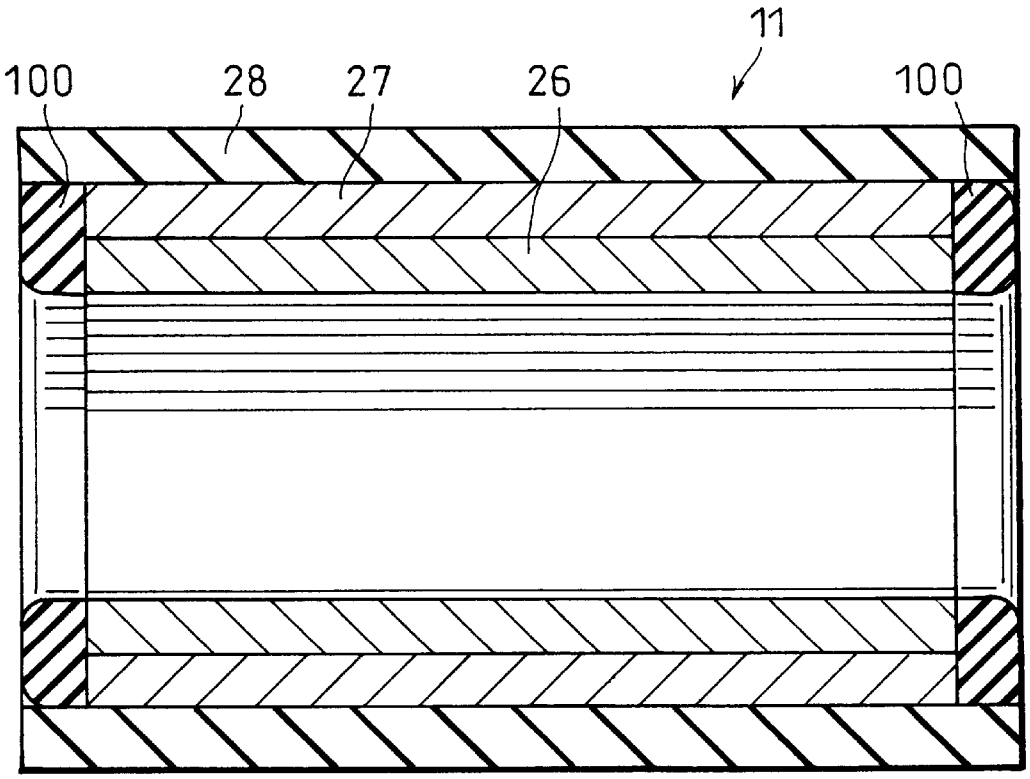
FIG. 11 is a cross-sectional view for explaining still another insulating material application with respect to the transfer drum.

The transfer drum 11 shown in FIG. 11 is arranged such that the ends of the semi-conductive layer 27 and the conductive layer 26 are covered with the insulating material 100 for the insulating purpose. In this case, the insulating material 100 may be formed in a ring shape so that the ring-shaped insulating material 100 may be installed in a region on an inner side to the jut ends of the dielectric layer 28.

Figure 12:
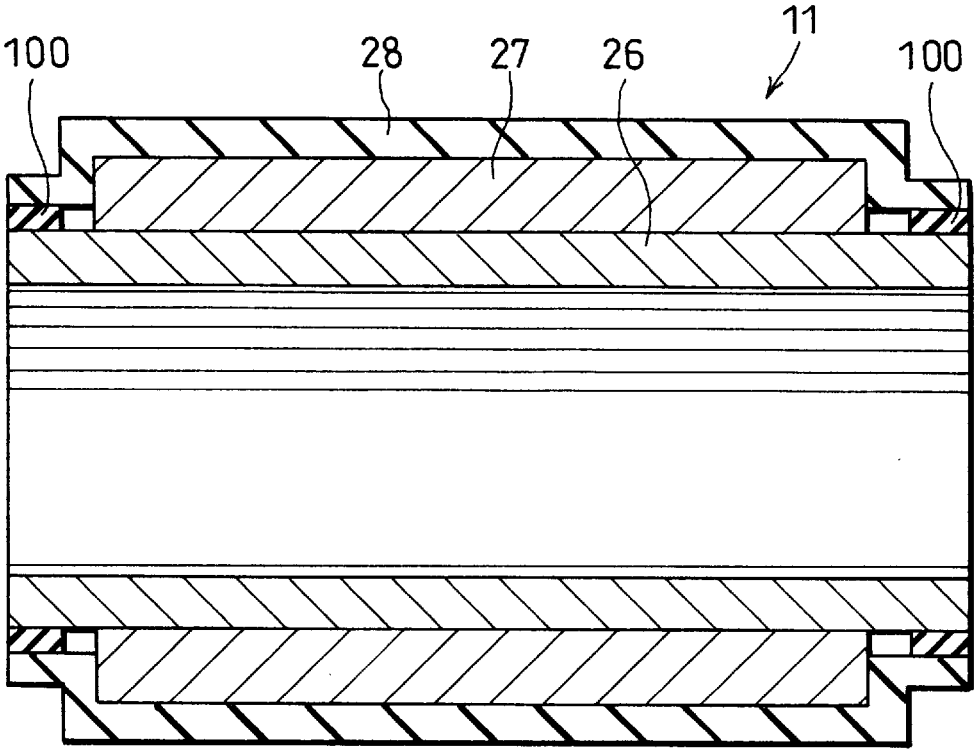
FIG. 12 is a cross-sectional view for explaining still another insulating material application with respect to the transfer drum.

The transfer drum 11 shown in FIG. 12 is arranged such that the ends of the conductive layer 26 and the dielectric layer 28 jut out, compared with the ends of the semi-conductive layer 27, and that the jut ends of the dielectric layer 28 and the conductive layer 26 are combined with the insulating material 100 provided therebetween. In this case, the insulating material 100 may be formed in a ring shape so that on each side of the transfer drum 11, the ring-shaped insulating material 100 may be installed between an inner surface of the jut end of the dielectric layer 28 and an outer surface of the jut end of the conductive layer 26.

Figure 13:
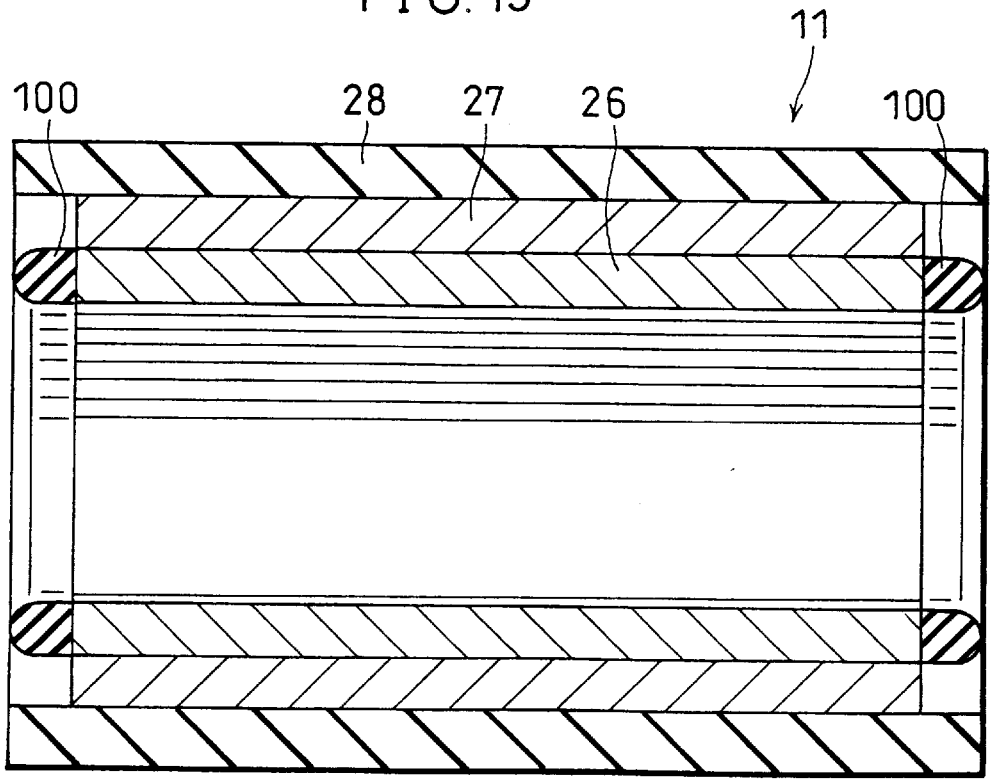
FIG. 13 is a cross-sectional view for explaining still another insulating material application with respect to the transfer drum.

The transfer drum 11 shown in FIG. 13 is arranged such that the insulating material 100 is applied to only the ends of the conductive layer 26 for the insulating purpose. In this case, the insulating material 100 may be formed in a ring shape so that on each side, the ring-shaped insulating material 100 may be fit in a region on an inner side to the jut end of the dielectric layer 28.

Anything may be used as the insulating material 100, viscous material or solid material, provided that it has high insulating property. For example, TOSHIBA SILICONE LIQUID GLUE TSE389, 399, DOW CORNING TORAY SILICONE MONO-COMPONENT SILICONE SEALANT ALCOHOL SE9186 CLEAR, or the like may be used.

Then, in the case where the insulating material 100 is a viscous material, it may be directly applied to ends of the transfer drum 11. In the case where the insulating material 100 is a solid material, it may be molded in shapes in accordance with the shapes of the ends of the transfer drum 11, and the resultant molds are fixed in the end sections.

In all the arrangements shown in FIGS. 1(*a*) and 1(*b*), 8 through 13, the both ends of the dielectric layer 28 jut out, compared with the ends of the semi-conductive layer 27 and the conductive layer 26, but the present invention is not limited to this arrangement. However, jutting out the ends of the dielectric layer 28 makes long a creepage distance of charge conducting the surface of the dielectric layer 28, thereby attaining a high insulating effect.

Dew of water tends to be formed inside the semi-conductive layer 27 when the ambient temperature suddenly changes, in the case of the arrangement wherein the ends of the semi-conductive layer 27 are exposed to the atmosphere while air is contained in the semi-conductive layer 27, for example, the semi-conductive layer 27 is made of a foam material. In the insulating arrangements shown in FIGS. 8 through 12, however, the semi-conductive layer 27 is sealed by the dielectric layer 28, the conductive layer 26, and the insulating material 100, thereby resulting in that the formation of water dew in the semi-conductive layer 27 is prevented.

In the case where exchange of the air inside the semi-conductive layer 27 with the atmosphere is eliminated by completely sealing the semi-conductive layer 27, however, the following drawback may arise: as a result of expansion and shrinkage of the air in the sealed space due to ambient temperature changes, the dielectric layer 28 outside the semi-conductive layer 27 tends to get creased, whereby electrostatic attraction of the transfer paper P in a good state may become impossible.

Figure 14:
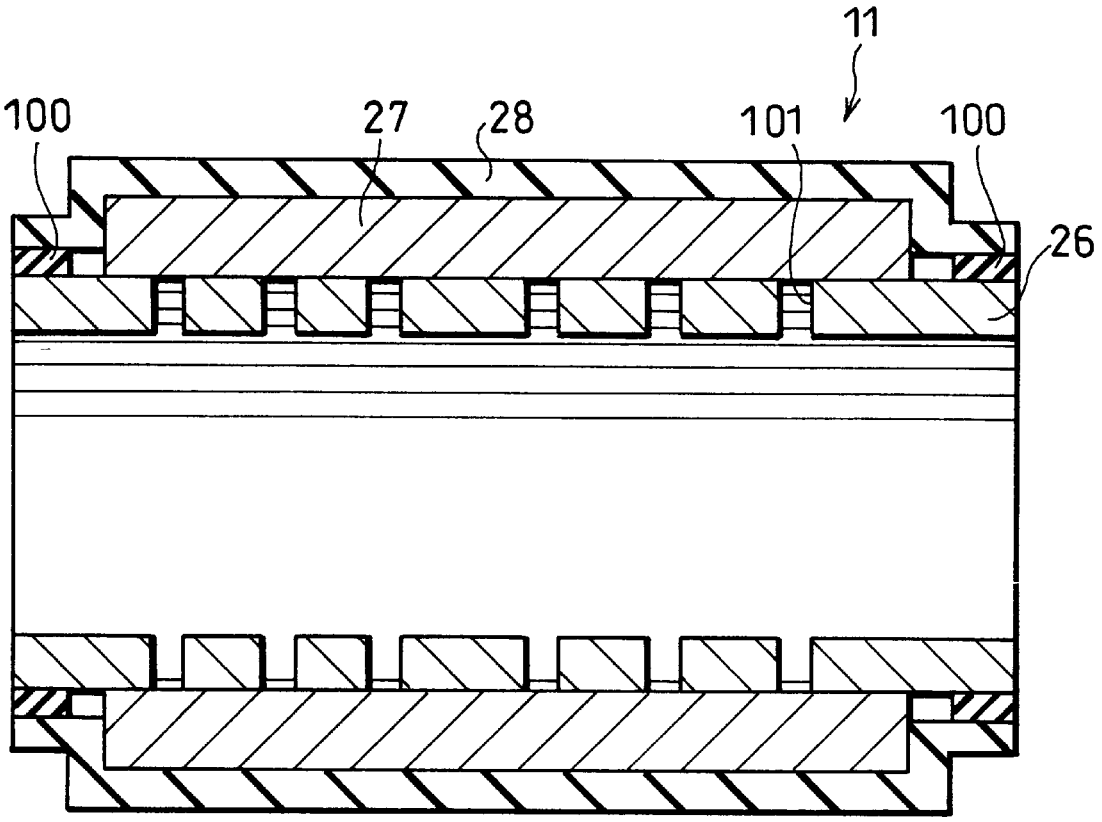
FIG. 14 is a cross-sectional view for explaining still another insulating material application with respect to the transfer drum.

Therefore, as shown in FIG. 14, it is desirable that a plurality of piercing pores 101 are provided in the conductive layer 26 so that the semi-conductive layer 27 is not completely sealed. By doing so, deformation of the semi-conductive layer 27 due to changes of ambient conditions is prevented, whereby deformation of the dielectric layer 28 is prevented. The size, shape, and number of the piercing pores 101 are not particularly limited, and any piercing pores 101 may be acceptable provided that they allow stable voltage supply to the semi-conductive layer 27 as well as allow the semi-conductive layer 27 to be fixed on the conductive layer 26. Normally, caps are provided to the both ends of the transfer drum 11, thereby sealing the conductive layer 26 so as to be airtight. Therefore, even though the semi-conductive layer 27 is unsealed by the pores 101, there is no possibility of formation of water dew in response to temperature changes, unlike the case where the semi-conductive layer 27 are exposed in the end sections of the transfer drum 11.

The following description will explain attraction of and transfer to the transfer paper P by the transfer drum 11, while referring to FIGS. 15 through 18. Here, it is assumed that a positive voltage is applied by the power source 32 to the conductive layer 26 of the transfer drum 11.

First, a system of attracting the transfer P will be explained in detail.

The electrostatic attraction of the transfer paper P to the transfer drum 11 is caused by electric charge of the transfer paper P having a polarity opposite to that of the voltage applied to the conductive layer 26, which charge is rendered to the transfer paper P by contact charging. Contact charging is carried out by Paschen discharge and charge injection.

Figure 15:
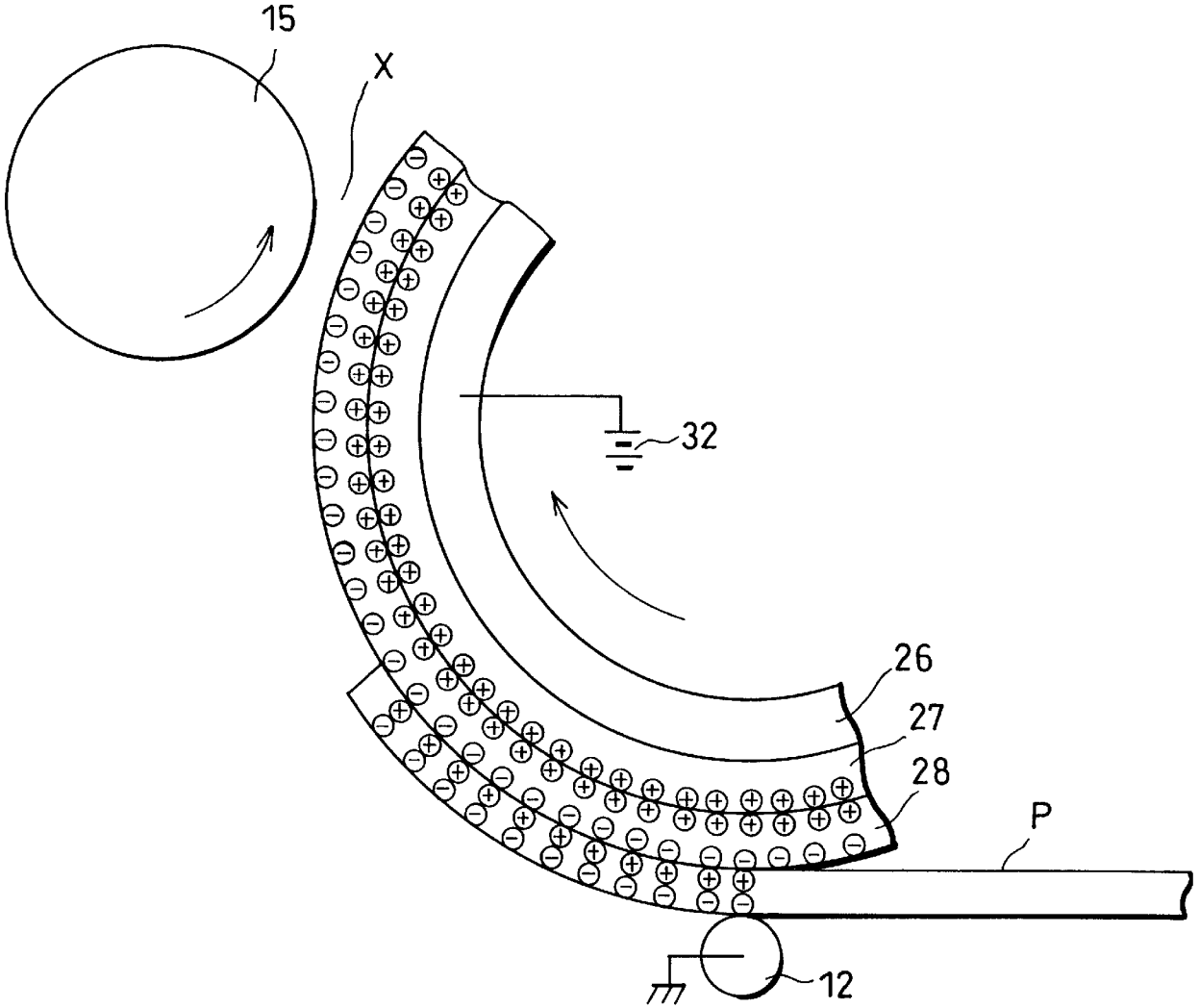
FIG. 15 is an explanatory view illustrating a charged state of the transfer drum, which is a state immediately after the transfer paper transported reaches the transfer drum.
Figure 17:
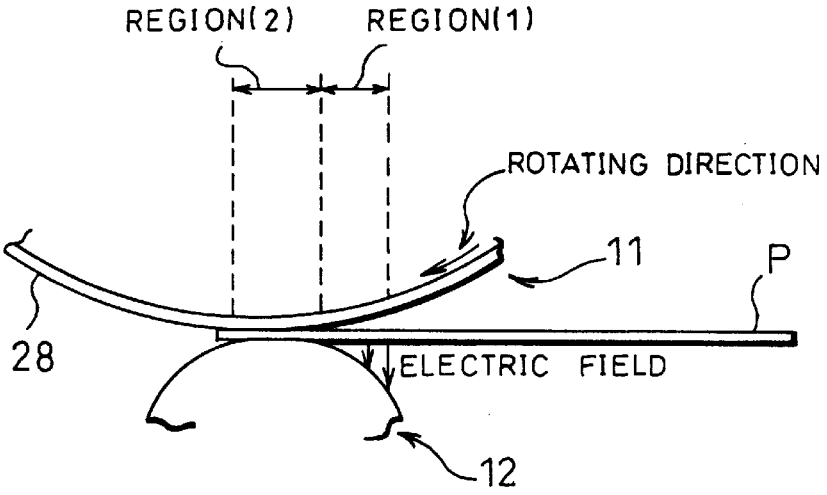
FIG. 17 is an explanatory view illustrating Paschen discharge occurring in a nip between the transfer drum and a ground roller.

More specifically, as shown in FIG. 15, the transfer P is transported to the transfer drum 11 in a direction crossing a line connecting the both ends of the transfer drum 11. In other words, the transfer paper P is transported so that the edges, in the width direction, of the transfer paper P do not go out of a region between the ends of the transfer drum 11. The transfer paper P thus transported to the transfer drum 11 is pressed by the ground roller 12 against the surface of the dielectric layer 28, and electric charge accumulated in the semi-conductive layer 27 moves to the dielectric layer 28, thereby inducing positive charge on the surface of the dielectric layer 28 in contact with the semi-conductive layer 27. Then, as shown in FIG. 17, as the ground roller 12 and the dielectric layer 28 of the transfer drum 11 get closer to each other and an electric field around the contact region (nip) where the dielectric layer 28 and the ground roller 12 come into contact becomes stronger, aerial insulation breakdown occurs, thereby causing discharge, i.e., Paschen discharge, from the transfer drum 11 side to the ground roller 12 side. A region (1) is adjacent to the nip, in an upstream side to the nip in the transport direction of the transfer paper P.

With this arrangement, negative charge is induced on a surface of the transfer drum 11 (i.e., the surface of the dielectric layer 28 coming into contact with the transfer paper P), whereas positive charge is induced on an inner surface of the transfer paper P (i.e., a surface portion of the transfer paper P coming into contact with the dielectric layer 28).

Further, after the discharge, electric charge is injected from the ground roller 12 to the transfer drum 11 in the nip (a region (2) shown in FIG. 17) between the ground roller 12 and the transfer drum 11, thereby further inducing negative charge on an outer surface of the transfer paper P (i.e., a surface of the transfer paper P coming into contact with the ground roller 12).

Figure 18:
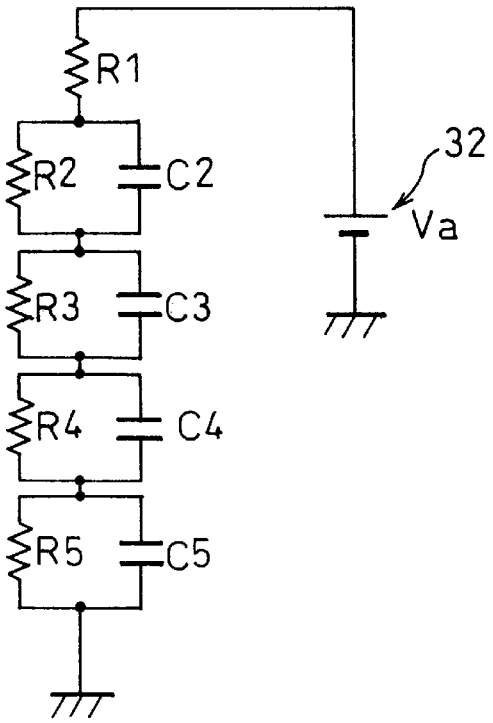
FIG. 18 is a circuit diagram illustrating an equivalent circuit of a charge injecting system between the transfer drum and the ground roller.
Figure 19:
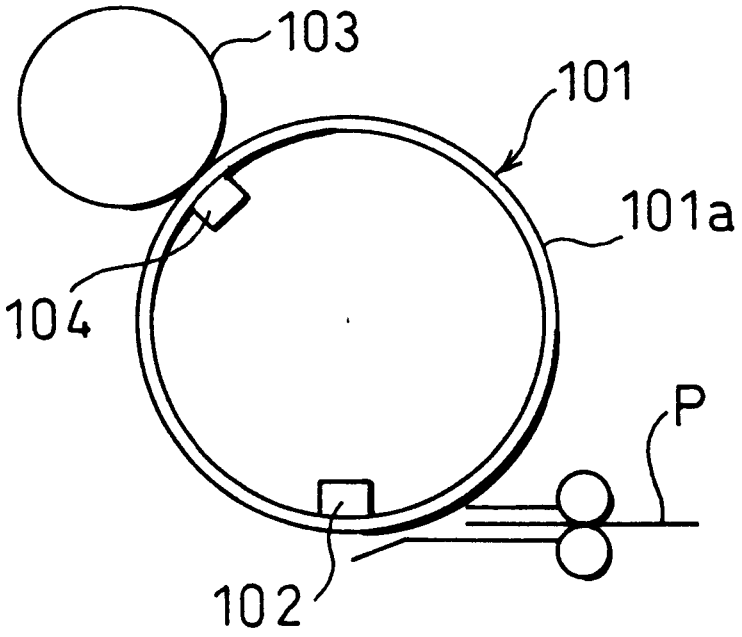
FIG. 19 is a view illustrating an arrangement of a transfer section of a conventional image forming apparatus.
Figure 20:
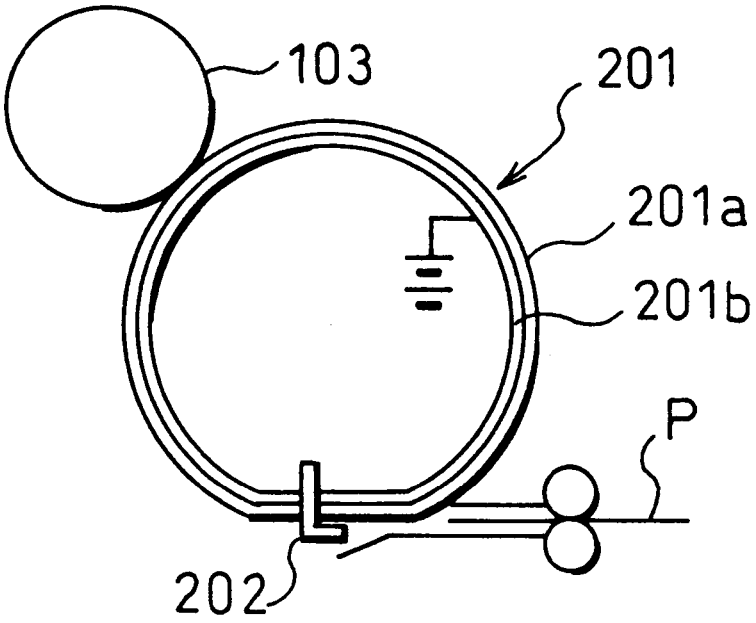
FIG. 20 is a view illustrating an arrangement of a transfer section of another conventional image forming apparatus.

FIG. 18 shows an equivalent circuit of a charge injecting system after the Paschen discharge. Va represents a voltage applied by the power source 32 to the conductive layer 26. R1 represents a resistance of the semi-conductive layer 27. R2 represents a contact resistance between the semi-conductive layer 27 and the dielectric layer 28. R3 represents a resistance of the dielectric layer 28. R4 represents a resistance of the transfer paper P. R5 represents a contact resistance between the transfer paper P and the ground roller 12. C2 represents a capacity between the semi-conductive layer 27 and the dielectric layer 28. C3 represents a capacity of the transfer P. C5 represents a capacity between the ground roller 12 and the transfer paper P.

Here, to determine a quantity of electric charge (potential) accumulated on the transfer paper P, let a charge quantity (potential) due to the Paschen discharge be an initial potential, and the foregoing equivalent circuit is solved for a potential difference applied to C5. A potential of the transfer paper P is a total potential as a result of both the Paschen discharge and the charge injection. A final charge potential V1 of the transfer paper P thus found is expressed by the following formula (1):

$$V1=A\times(b'\times e^{Bt}-c'\times e^{Ct}) \quad (1)$$

Here, A, B, C, b', and c' in the formula represent constants depending on the foregoing circuit (depending on respective resistances, capacities, and the like of the layers). Therefore, the final potential V1 is expressed as a sum of exponential functions which alter as a time t elapses.

Thus, since the charge accumulated on the outer surface of the transfer paper P has the polarity opposite to that of the voltage applied to the conductive layer 26, an electrostatic attractive force is exerted between the transfer paper P and the conductive layer 26, thereby causing the transfer paper P to adhere to the transfer drum 11. In other words, it appears that as the potential of the transfer paper P is higher, the electrostatic attractive force causing the transfer paper P to adhere to the transfer drum 11 is greater.

Besides, with rotations of the ground roller 12 and the transfer drum 11, the surface of the transfer drum 11 is uniformly charged. As the transfer drum 11 rotates in an arrow direction, the transfer paper P adhering to the transfer drum 11 is transported to a transfer point X at which the toner image is transferred. While the transport, the outer surface of the transfer paper P remains negatively charged. Then, at the transfer point X, transfer of the toner image is performed.

The following description will explain a transfer process of transferring a toner image to the transfer paper P.

Figure 16:
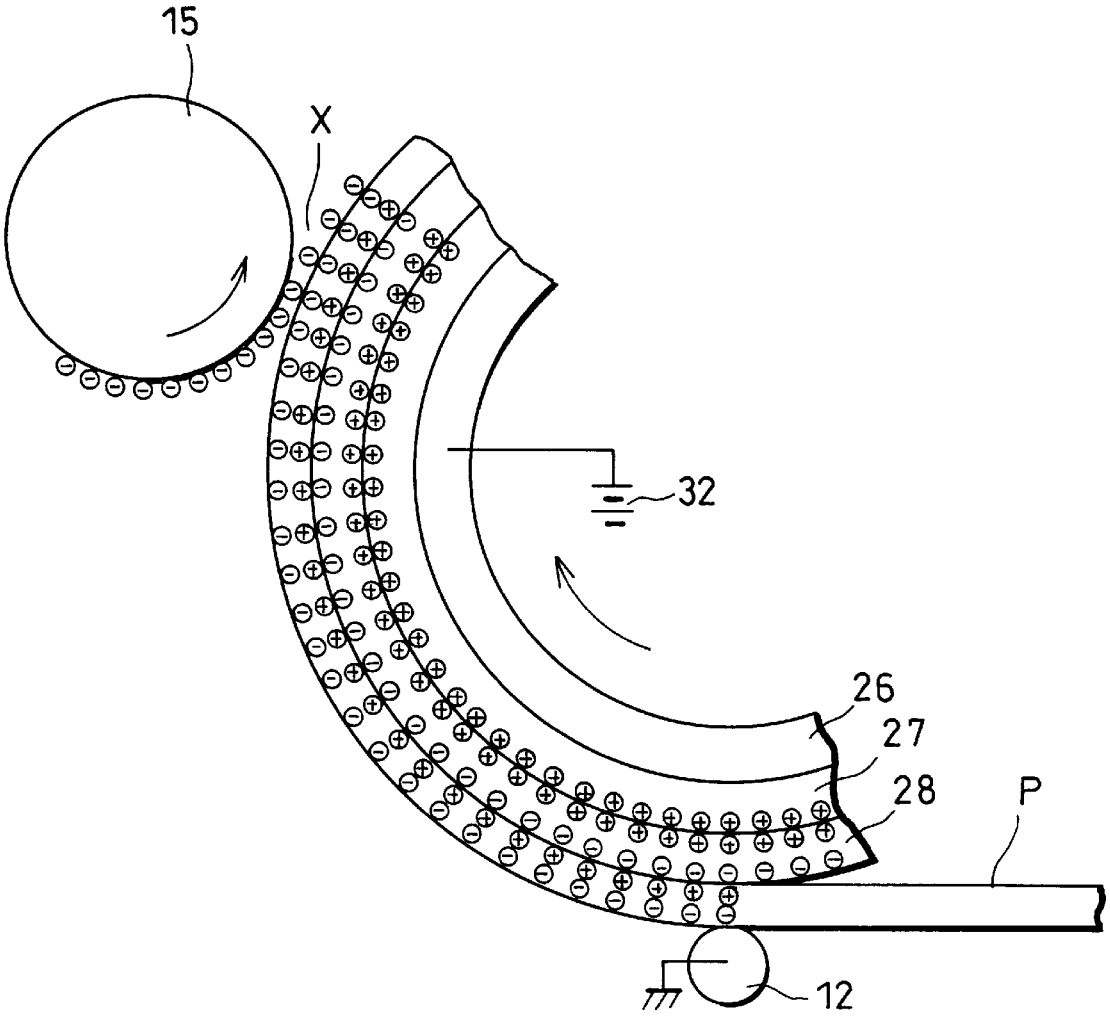
FIG. 16 is an explanatory view illustrating a charged state of the transfer drum, which is a state when the transfer paper reaches a transfer position on the transfer drum.

Toner particles having negative charge on their surfaces adhere to the surface of the photosensitive drum 15, as shown in FIG. 16. It therefore seems that when the transfer paper P whose surface is negatively charged is transported to the transfer point X, a repulsive force would be generated between the transfer P and the toner on the photosensitive drum 15. An attractive force which overwhelms the repulsive force, however, is also generated between the transfer paper P and the photosensitive drum 15 by the power source 32. As a result the toner image is transferred onto the transfer paper P.

The following description will explain the property of maintaining the electrostatic attractive force exerted to the transfer paper P.

Decline of charge (potential) accumulated on the transfer paper P as time elapses should be taken into consideration. In other words, to electrostatically attracting the transfer paper P to the dielectric layer 28 in a stable manner, it is necessary to maintain the charge accumulated on the transfer paper P without decline. Then, a declining property of the charge on the transfer paper P which is electrostatically attracted to the dielectric layer 28 is determined by analysis, and it is expressed by the following formula (2):

$$pV + q\log(V) = -\frac{t}{\varepsilon S} + N \tag{2}$$

where p and q represent constants depending on the respective resistances of the layers, t represents a declining time of charge during transfer, $\epsilon$ represents respective dielectric constants of the layers, S represents an area of the transfer paper, N represents an integration constant, and V represents a potential of the transfer paper.

From the formula (2), it is understood that the potential V of the transfer paper P declines as the time t elapses. It is also understood that a declining rate of the charge on the transfer paper P depends on the dielectric constants and resistances of the layers constituting the transfer drum 11, and hence the charge declines more slowly as the dielectric constants are greater and the resistances are higher.

The above formula (2), however, applies in the case where the transfer paper P, the dielectric layer 28, or the semi-conductive layer 27 has a high surface electrical resistance, and it is considered that under conditions of high temperature and high humidity, the charge necessary for the electrostatic attraction may go to the conductive layer 26 through the surface electrical resistances of the layers, thereby declining.

Therefore, varying the volume resistivity of the dielectric layer 28, the property of electrostatically attracting the transfer paper P in each case was evaluated under conditions of high temperature and high humidity. The result is shown in Table 1 below.

TABLE 1

| VOLUME RESISTIVITY OF DIELECTRIC LAYER (Ωcm) | $10^9$ or less | $10^9$ | $10^{10}$ | $10^{11}$ | $10^{12}$ | $10^{13}$ | $10^{14}$ | $10^{15}$ or above |
|---|---|---|---|---|---|---|---|---|
| ELECTRO-STATIC ATTRACTION | X | X | X | X | X | X | Δ | Δ |

TABLE 1-continued

| VOLUME RESISTIVITY OF DIELECTRIC LAYER (Ωcm) | $10^9$ or less | $10^9$ | $10^{10}$ | $10^{11}$ | $10^{12}$ | $10^{13}$ | $10^{14}$ | $10^{15}$ or above |
|---|---|---|---|---|---|---|---|---|
| OF TRANSFER PAPER | | | | | | | | |

(○: GREAT EFFECT, Δ: NORMAL EFFECT, X: NO EFFECT)

As shown in Table 1, the transfer paper P was not at all electrostatically attracted in the case where the transfer drum 11 was electrically opened with no insulating arrangement applied to the ends thereof. This seems because the charge of the transfer paper P which had been charged by the ground roller 12 moved away and declined through the ends of the dielectric layer 28 and the semi-conductive layer 27.

Therefore, to prevent the charge which moves through the surface of the dielectric layer 28 from further moving via the ends of the dielectric layer 28 to the ends of the semi-conductive layer 27 thereby declining, the ends of the transfer drum 11 were insulated, and varying the volume resistivity of the dielectric layer 28, the property of electrostatically attracting the transfer paper P in each case was evaluated under conditions of high temperature and high humidity. The result is shown in Table 2 below.

TABLE 2

| VOLUME RESISTIVITY OF DIELECTRIC LAYER (Ωcm) | $10^9$ or less | $10^9$ | $10^{10}$ | $10^{11}$ | $10^{12}$ | $10^{13}$ | $10^{14}$ | $10^{15}$ | $10^{15}$ or above |
|---|---|---|---|---|---|---|---|---|---|
| ELECTROSTATIC ATTRACTION OF TRANSFER PAPER | X | Δ | Δ | Δ | ○ | ○ | ○ | ○ | ○ |

(○: GREAT EFFECT, Δ: NORMAL EFFECT, X: NO EFFECT)

As clear from Table 2, the property of electrostatically attracting the transfer paper P was remarkably enhanced and stabilized in the case where the volume resistivity of the dielectric layer was set to $10^9$ Ω·cm to $10^{15}$Ω·cm and the ends of the transfer drum 11 were insulated. It can be considered that in the case where the volume resistivity is less than $10^9$Ω·cm, most charge moves in a thickness direction due to the small volume resistivity, thereby declining, and as a result stable attracting property cannot be attained. On the other hand, in the case where the volume resistivity is $10^{15}$ Ω·cm or above, the attracting and holding force is increased, whereas there arise drawbacks in safety and cost performance since the voltage necessary for the toner transfer in the region of contact with the photosensitive drum 15 has to be considerably raised.

In short, from the above result, it can be concluded that the dielectric layer 28 of the transfer drum 11 is preferably designed so as to have a volume resistivity of $10^9$Ω·cm to $10^{15}$Ω·cm, with view to improving the property of electrostatically attracting and holding the transfer paper P.

Subsequently, insulating the ends of the transfer drum 11, and varying the volume resistivity of the dielectric layer 28, the property of electrostatically attracting the transfer paper P in each case was evaluated under conditions of high temperature and high humidity. The result is shown in Table 3 below.

TABLE 3

| THICKNESS OF DIELECTRIC LAYER (μm) | 50 or less | 50 | 80 | 100 | 150 | 180 | 200 | 200 or above |
|---|---|---|---|---|---|---|---|---|
| ELECTROSTATIC ATTRACTION OF TRANSFER PAPER | X | Δ | ○ | ○ | ○ | ○ | Δ | X |

(○: GREAT EFFECT, Δ: NORMAL EFFECT, X: NO EFFECT)

As clear from Table 3, the dielectric layer 28 preferably has a thickness of not less than 50 μm not more than 200 μm. In the case where the thickness of the dielectric layer 28 is less than 50 μm, it is too thin, whereby the resistance becomes lower and the charge of the transfer paper P which is once electrostatically attracted rapidly declines. As a result, stable attracting property cannot be obtained. Besides, since it is too thin, the durability thereof impairs. On the other hand, in the case where the dielectric layer 28 has a thickness of 200 μm or above, the adhesion thereof with the semi-conductive layer 27 deteriorates, whereby its shape and dimension cannot be stably and accurately maintained and good electrostatic attraction of and toner transfer to the transfer paper P cannot be achieved.

In short, from the above result, it can be concluded that the dielectric layer 28 of the transfer drum 11 is preferably designed so as to have a thickness of 50 μm to 200 μm, with view to improving the property of electrostatically attracting and holding the transfer paper P.

Subsequently, to determine optimal surface electrical resistance and volume resistivity of the insulating material 100 applied to the ends of the transfer drum 11 for the insulating purpose, the property of electrostatically attracting the transfer paper P was evaluated while varying the surface electrical resistance and the volume resistivity. The result of the experiment on the surface electrical resistance is shown in Table 4 below, and the result of the experiment on the volume resistivity is shown in Table 5 below.

TABLE 4

| SURFACE ELECTRICAL RESISTANCE OF INSULATING MATERIAL (Ω) | $10^6$ or less | $10^7$ | $10^8$ | $10^9$ | $10^{10}$ | $10^{11}$ | $10^{12}$ | $10^{13}$ or above |
|---|---|---|---|---|---|---|---|---|
| ELECTROSTATIC ATTRACTION OF TRANSFER PAPER | X | X | X | X | Δ | Δ | ○ | ○ |

(○: GREAT EFFECT, Δ: NORMAL EFFECT, X: NO EFFECT)

As clear from Table 4, the insulating material 100 preferably has a surface electric resistance of not less than $10^{10}\Omega$, and more preferably, not less than $10^{12}\Omega$. In the case where the surface electric resistance is less than $10^{10}\Omega$, a sufficient insulating effect with respect to the ends of the transfer drum 11 cannot be achieved due to the too small surface electric resistance. More specifically, under conditions of high temperature and high humidity, the charge on the transfer paper P moves away from the ends of the transfer drum 11 through the surfaces of the insulating material 100 thereby declining, and hence stable electrostatic attraction and hold of the transfer paper P is impossible. On the other hand, in the case where the surface electric resistance is not less than $10^{10}\Omega$, the moving away of charge through the ends of the transfer drum 11 does not occur, whereby stable electrostatic attraction of the transfer paper P can be achieved even under conditions of high temperature and high humidity.

In short, from the above result, it can be concluded that an insulating material having a surface electrical resistance of $10^{10}\Omega$ or above is preferably adapted to be used as the insulating material 100 applied to the ends of the transfer drum 11 for the insulating purpose, so that decline of charge through the ends of the transfer drum 11 is prevented and the electrostatic attraction and hold of the transfer paper P is improved.

TABLE 5

| VOLUME RESISTIVITY OF INSULATING MATERIAL (Ωcm) | $10^9$ or less | $10^{10}$ | $10^{11}$ | $10^{12}$ | $10^{13}$ | $10^{14}$ | $10^{15}$ | $10^{16}$ or above |
|---|---|---|---|---|---|---|---|---|
| ELECTRO-STATIC ATTRACTION OF TRANSFER PAPER | X | X | X | Δ | Δ | ○ | ○ | ○ |

(○: GREAT EFFECT, Δ: NORMAL EFFECT, X: NO EFFECT)

As clear from Table 5, the insulating material 100 preferably has a volume resistivity of not less than $10^{12}$ Ω·cm, and more preferably, not less than $10^{14}$ Ω·cm. In the case where the volume resistivity is less than $10^{12}$ Ω·cm, a sufficient insulating effect with respect to the ends of the transfer drum 11 cannot be achieved due to the too small volume resistivity. More specifically, under conditions of high temperature and high humidity, the charge on the transfer paper P moves away from the ends of the transfer drum 11 in the insulating material thickness direction, thereby declining, and hence stable electrostatic attraction and hold of the transfer paper P is impossible. On the other hand, in the case where the volume resistivity is not less than $10^{12}$ Ω·cm, the moving away of charge through the ends of the transfer drum 11 does not occur, whereby stable electrostatic attraction of the transfer paper P can be achieved even under conditions of high temperature and high humidity.

In short, from the above result, it can be concluded that an insulating material having a volume resistivity of $10^{12}$ Ω·cm or above is preferably adapted to be used as the insulating material 100 applied to the ends of the transfer drum 11 for the insulating purpose, so that decline of charge through the ends of the transfer drum 11 is prevented and the electrostatic attraction and hold of the transfer paper P is improved.

Finally, the image forming process in the image forming apparatus arranged as described above will be briefly explained, with reference to FIGS. 2 and 3.

First of all, in the case of the automatic feeding, as shown in FIG. 2, the transfer paper P is fed to the PF rollers 8 by the pickup roller 7 sheet by sheet from the topmost sheet of the transfer paper P stored in the feed cassette 5 which is disposed on the lowest level of the main body of the image forming apparatus. The transfer paper P having passed between the PF rollers 8 is curled along the surface shape of the transfer drum 11 by the pre-curl rollers 10. In the case of the manual feeding, the transfer paper P is manually supplied sheet by sheet from the manual-feed section 6 located on the front side of the main body, and then, it is transported by the manual-feed rollers 9 to the pre-curl rollers 10.

Subsequently, the transfer paper P is transported to between the transfer drum 11 and the ground roller 12, as shown in FIG. 3. Then, Paschen discharge occurs from the transfer drum 11 side to the ground roller 12 side. After the discharge, electric charge injection occurs at the nip between the ground roller 12 and the transfer drum 11, thereby inducing charge on the surface of the transfer paper P. This charge causes the transfer paper P to be electrostatically attracted to the surface of the transfer drum 11.

Thereafter, the transfer paper P thus attracted to the transfer drum 11 is transported to the transfer point X at which the transfer drum 11 and the photosensitive drum 15 come into contact with pressure. Here, due to the potential difference between the charge of toner adhering to the photosensitive drum 15 and the charge caused by the voltage applied to the conductive layer 26 by the power source 32, the toner image is transferred onto the transfer paper P.

At this time, on the transfer drum 15, a series of charging, exposure, development and transfer operations are performed for each color. Thus, the transfer paper P adhering to the transfer drum 11 is moved in a circular course by a rotation of the transfer drum 11. A one-color image is transferred with one rotation of the transfer drum 11, and a full-color image is obtained with the maximum of four rotations. When producing a black-and-white image or a mono-color image, it is only necessary to have one rotation of the transfer drum 11.

When all of the toner images have been transferred to the transfer paper P, the transfer paper P is, as shown in FIG. 2, forced to separate from the surface of the transfer drum 11 by the separating claw 14 which is provided touchable to the circumference of the transfer drum 11, and guided by the fixing guide 22 to the fixing rollers 23. Here, the toner image on the transfer paper P is fused and fixed onto the transfer paper P by the heat and pressure of the fixing rollers 23. After fixation, the transfer paper P is discharged by the discharge roller 24 onto the output tray 25. Thus, the image formation with respect to a sheet of the transfer paper P is completed.

As described above, the image forming apparatus is arranged so that the insulating material 100 is applied to the ends of at least one of the dielectric layer 28, the semi-conductive layer 27, and the conductive layer 26 of the transfer drum 11 of the transfer section 2.

With this arrangement, decline of charge by no means occur due to the insulating material 100 applied to the ends of the transfer drum 11, even in the case where the apparatus is used under conditions of high temperature and high humidity, although in such a state, usually the surface electric resistances of the dielectric layer 28 and the semi-conductive layer 27 lower, and makes it possible for the charge accumulated on the transfer paper P to conduct through the surface of the dielectric layer 28 whose surface electric resistance is low, then enter the semi-conductive layer 27 through the ends of the transfer drum 11, and move to the conductive layer 26 through the surface of the semi-conductive layer 27. As a result, stable electrostatic attraction of the transfer paper P in any environment is enabled, thereby ensuring stable toner transfer.

The image forming apparatus of the present invention is arranged so as to comprise (1) an image carrying body on whose surface a toner image is formed, and (2) transfer means for transferring the toner image formed on the image carrying body to a transfer material, by bringing the transfer material into contact with the image carrying body, the transfer means including (i) a transfer main body, rotatably provided, having a dielectric layer, a semi-conductive layer and a conductive layer laminated in this order from a contact surface side of the transfer material, (ii) voltage applying means for applying a predetermined voltage to the conductive layer, and (iii) potential-difference producing means for pressing the transfer material against a surface of the dielectric layer, and for producing a potential difference between the conductive layer to which the voltage has been applied and the transfer material, the potential-difference producing means being provided on an upstream side to a transfer position in a transporting direction of the transfer material, wherein an insulating material is applied to ends of at least one of the dielectric layer, the semi-conductive layer, and the conductive layer, the ends thereof being ends in a direction orthogonal to a rotating direction of the transfer main body.

As a scheme for insulating the ends of the transfer main body, there is a scheme wherein the dielectric layer is formed so that the ends thereof jut out compared with the ends of the semi-conductive layer and the ends of the conductive layer, and the insulating material is applied to the jut ends.

By this scheme, the creepage distance of the charge going through the surface of the dielectric layer is prolonged, thereby making the charge's moving the more difficult for the prolongation. Thus, the insulating effect is great.

Further, there is another scheme wherein the dielectric layer and the conductive layer are formed so that the ends thereof jut out compared with the ends of the semi-conductive layer and the jut ends adhere to each other with the insulating material provided therebetween.

In a state where air is contained in the semi-conductive layer, for example, the semi-conductive layer is made of a foam material, while the ends of the semi-conductive layer are exposed to atmosphere, dew of water tends to occur in the semi-conductive layer when the ambient temperature suddenly changes. Therefore, by sealing the ends of the semi-conductive layer by using the insulating material so as to make the semi-conductive layer unexposed to atmosphere, it is possible to prevent the formation of dew in the semi-conductive layer.

The image forming apparatus of the present invention may be arranged so that the conductive layer has a plurality of piercing pores.

The semi-conductive layer tends to deform when air expands or shrinks in response to changes of the ambient conditions, in the case where the semi-conductive layer contains air therein, for example, being made of a foam material, while it is sealed by the conductive layer, the dielectric layer and the insulating material as described above. Such deformation of the semi-conductive layer causes the dielectric layer formed thereon to deform as well and get creased. As a result, satisfactory attraction of the transfer material and toner transfer cannot be performed. However, by providing piercing pores in the conductive layer so that the semi-conductive layer is not completely sealed, deformation of the dielectric layer in response to changes in the ambient conditions can be prevented, whereby the dielectric layer is maintained in an accurate shape and dimension. As a result, stable electrostatic attraction of the transfer material and stable toner transfer can be performed.

Furthermore, in the image forming apparatus of the present invention, the insulating material preferably has a surface electric resistance of not less than $10^{10}$ Ω. In the case where an insulating material having a surface electric resistance of less than $10^{10}$ Ω is used, under conditions of high temperature and high humidity, the charge sometimes moves through the surface of the insulating material, from the dielectric layer to the semi-conductive layer, then to the conductive layer thereby declining. In contrast, in the case where the insulating material having a surface electric resistance of not less than $10^{10}$ Ω is used, the ends of the transfer main body are surely insulated even under conditions of high temperature and high humidity. Therefore, stable electrostatic attraction of the transfer material is further ensured in any environment, and stable toner transfer can be performed.

In the image forming apparatus of the present invention, the insulating material preferably has a volume resistivity of not less than $10^{12}$ Ω·cm. In the case where an insulating material having a volume resistivity of less than $10^{12}$ Ω·cm, under conditions of high temperature and high humidity, the charge sometimes moves in a thickness direction of the insulating material (volume resistivity direction), from the dielectric layer to the semi-conductive layer, then to the conductive layer, thereby declining. In contrast, in the case where the insulating material having a volume resistivity of not less than $10^{12}$ Ω·cm is used, the ends of the transfer main body are surely insulated even under conditions of high temperature and high humidity. Therefore, stable electrostatic attraction of the transfer material is further ensured in any environment, and stable toner transfer can be performed.

Furthermore, in the image forming apparatus of the present invention, the dielectric layer preferably has a volume resistivity of $10^{9}$ Ω·cm to $10^{15}$ Ω·cm. Even if the ends of the transfer main body are insulated, the charge still moves in a thickness direction of the dielectric layer in the case where the volume resistivity of the dielectric layer is too low. On the contrary, in the case where the volume resistivity of the dielectric layer is too high, the toner-transfer-use voltage to be applied to a portion in contact with the image carrying body needs to be made considerably high, thereby causing drawbacks in safety and cost performance. Therefore, by setting the volume resistivity of the dielectric layer to $10^{9}$ Ω·cm to $10^{15}$ Ω·cm, the effect of the insulation of the transfer main body is fully enjoyed. By doing so, stable electrostatic attraction of the transfer material is ensured in any environment, and stable toner transfer can be performed.

Furthermore, in the image forming apparatus of the present invention, the dielectric layer preferably has a thickness of 50 μm to 200 μm. Even if the ends of the transfer main body are insulated, the charge moves in a thickness direction of the dielectric layer in the case where the dielectric layer is thin. Besides, durability in this case is poor. On the other hand, in the case where the dielectric layer is too thick, adhesion thereof to the semi-conductive layer impairs, whereby accurate shape and dimension of the dielectric layer cannot be stably maintained in various conditions. Therefore, by setting the thickness of the dielectric layer to 50 μm to 200 μm, the effect of the insulation of the transfer main body is fully enjoyed. By doing so, stable electrostatic attraction of the transfer material is ensured in any environment, and stable toner transfer can be performed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

an image carrying body on which a toner image is formed; and transfer means for transferring the toner image formed on said image carrying body to a transfer material, by bringing the transfer material into contact with said image carrying body while transporting the transfer material, wherein:

said transfer means includes a transfer main body having a dielectric layer, a semi-conductive layer, and a conductive layer laminated in this order from a contact surface side of the transfer material;

the transfer material is transported between ends of said transfer main body, in a direction crossing a direction of a line connecting the ends of said transfer main body; and an insulating material is applied to ends of at least one of said dielectric layer, said semi-conductive layer, and said conductive layer, the ends thereof being positioned at the ends of said transfer main body.

2. An image forming apparatus as set forth in claim 1, further comprising:

voltage applying means for applying a predetermined voltage to said conductive layer; and potential-difference producing means for pressing the transfer material against a surface of said dielectric layer, and for producing a potential difference between said conductive layer to which the voltage has been applied and the transfer material, said potential-difference producing means being provided on an upstream side to a transfer position in a transporting direction of the transfer material.

3. The image forming apparatus as set forth in claim 1, wherein:

the ends of said dielectric layer jut out, compared with the ends of said semi-conductive layer and the ends of said conductive layer; and said insulating material is applied to the jut ends of said dielectric layer.

4. The image forming apparatus as set forth in claim 1, wherein:

the ends of said dielectric layer jut out, compared with the ends of said semi-conductive layer and the ends of said conductive layer; and said insulating material is applied to the jut ends of said dielectric layer and the ends of said semi-conductive layer.

5. The image forming apparatus as set forth in claim 1, wherein:

the ends of said dielectric layer jut out, compared with the ends of said semi-conductive layer and the ends of said conductive layer; and said insulating material is applied to the jut ends of said dielectric layer as well as the ends of said semi-conductive layer and the ends of said conductive layer.

6. The image forming apparatus as set forth in claim 1, wherein:

the ends of said dielectric layer jut out, compared with the ends of said semi-conductive layer and the ends of said conductive layer; and said insulating material is applied to the ends of said semi-conductive layer.

7. The image forming apparatus as set forth in claim 6, wherein said insulating material is fit in a region on an inner side to each jut end of said dielectric layer.

8. The image forming apparatus as set forth in claim 1, wherein:

the ends of said dielectric layer jut out, compared with the ends of said semi-conductive layer and the ends of said conductive layer; and said insulating material is applied to the ends of said semi-conductive layer and the ends of said conductive layer.

9. The image forming apparatus as set forth in claim 8, wherein said insulating material is fit in a region on an inner side to each jut end of said dielectric layer.

10. The image forming apparatus as set forth in claim 1, wherein:

the ends of said dielectric layer jut out, compared with the ends of said semi-conductive layer and the ends of said conductive layer; and said insulating material is applied to the ends of said conductive layer.

11. The image forming apparatus as set forth in claim 10, wherein said insulating material is fit in a region on an inner side to each jut end of said dielectric layer.

12. The image forming apparatus as set forth in claim 1, wherein:

the ends of said dielectric layer and the ends of said conductive layer jut out, compared with the ends of said semi-conductive layer; and the jut end of said dielectric layer and the jut end of said conductive layer on each side adhere to each other with said insulating material provided therebetween.

13. The image forming apparatus as set forth in claim 12, wherein on each side, said insulating material is provided between an inner surface of the jut end of said dielectric layer and an outer surface of the jut end of said conductive layer.

14. The image forming apparatus as set forth in claim 1, wherein a plurality of piercing pores are provided in said conductive layer.

15. The image forming apparatus as set forth in claim 1, wherein said insulating material has a surface electric resistance of not less than $10^{10}$ Ω.

16. The image forming apparatus as set forth in claim 1, wherein said insulating material has a surface electric resistance of not less than $10^{12}$ Ω.

17. The image forming apparatus as set forth in claim 1, wherein said insulating material has a volume resistivity of not less than $10^{12}$ Ω·cm.

18. The image forming apparatus as set forth in claim 1, wherein said insulating material has a volume resistivity of not less than $10^{14}$ Ω·cm.

19. The image forming apparatus as set forth in claim 1, wherein said dielectric layer has a volume resistivity of $10^{9}$ Ω·cm to $10^{15}$ Ω·cm.

20. The image forming apparatus as set forth in claim 1, wherein said dielectric layer has a volume resistivity of $10^{12}$ Ω·cm to $10^{15}$ Ω·cm.

21. The image forming apparatus as set forth in claim 1, wherein said dielectric layer has a thickness of 50 μm to 200 μm.

22. The image forming apparatus as set forth in claim 1, wherein said dielectric layer has a thickness of 80 μm to 180 μm.

23. The image forming apparatus as set forth in claim 1, wherein said semi-conductive layer is made of a resilient foam material such as urethan rubber or elastomer.

24. The image forming apparatus as set forth in claim 1, wherein said insulating material is an insulating solid material molded in a shape in accordance with a shape of each end of said transfer main body.

25. The image forming apparatus as set forth in claim 1, wherein the ends of said semi-conductive layer are sealed by said insulating material so as to be unexposed to atmosphere.

26. The image forming apparatus as set forth in claim 1, wherein said dielectric layer is composed of a polymer film containing polyvinylidene fluoride.

27. The image forming apparatus as set forth in claim 26, wherein said dielectric layer is formed in a seamless cylindrical thin film and is fixed to said semi-conductive layer.

28. The image forming apparatus as set forth in claim 26, wherein said dielectric layer is stretched by pulling the ends thereof in a sheet winding direction with the use of pulling members, so that said dielectric layer is wound around and fixed to said semi-conductive layer.

29. The image forming apparatus as set forth in claim 1, wherein the ends of said transfer main body are capped.

* * * * *